US009545638B2

(12) United States Patent
Spiryagin et al.

(10) Patent No.: US 9,545,638 B2
(45) Date of Patent: Jan. 17, 2017

(54) METHOD AND SYSTEM FOR A MULTIPLE-ORIFICE NOZZLE

(75) Inventors: Kostantin Spiryagin, Petah-Tikva (IL); Lior Sirkis, Ramat Gan (IL)

(73) Assignee: HIGHCON SYSTEMS LTD., Yavne (IL)

( * ) Notice: Subject to any disclaimer, the term of this patent is extended or adjusted under 35 U.S.C. 154(b) by 99 days.

(21) Appl. No.: 14/342,118

(22) PCT Filed: Sep. 3, 2012

(86) PCT No.: PCT/IL2012/000329

§ 371 (c)(1),
(2), (4) Date: Aug. 7, 2014

(87) PCT Pub. No.: WO2013/030828

PCT Pub. Date: Mar. 7, 2013

(65) Prior Publication Data

US 2014/0374500 A1 Dec. 25, 2014

Related U.S. Application Data

(60) Provisional application No. 61/531,007, filed on Sep. 4, 2011.

(51) Int. Cl.

| | |
|---|---|
| ***B05B 3/00*** | (2006.01) |
| ***B05B 13/02*** | (2006.01) |
| ***B05B 1/14*** | (2006.01) |
| ***B05C 5/02*** | (2006.01) |
| *B05B 13/04* | (2006.01) |
| *B26F 1/44* | (2006.01) |

(52) U.S. Cl.

CPC . *B05B 1/14* (2013.01); *B05C 5/02* (2013.01); *B05C 5/0208* (2013.01); *B05C 5/0216* (2013.01); *B05B 13/0442* (2013.01); *B26F 2001/4463* (2013.01)

(58) Field of Classification Search

USPC ..... 118/300, 321, 323, 679–682, 313–315; 156/578; 239/597, 601

See application file for complete search history.

(56) References Cited

U.S. PATENT DOCUMENTS

| | | | | |
|---|---|---|---|---|
| 2,356,944 A | | 8/1944 | Peeps | |
| 4,406,247 A | * | 9/1983 | Baughman | B42C 9/00 118/678 |
| 4,521,456 A | | 6/1985 | Hanson | |
| 5,747,102 A | * | 5/1998 | Smith | B05C 5/001 222/1 |

(Continued)

OTHER PUBLICATIONS

International Search Report for PCT/IL2012/000329 dated Mar. 15, 2013.

*Primary Examiner* — Yewebdar Tadesse
(74) *Attorney, Agent, or Firm* — Sughrue Mion, PLLC

(57) ABSTRACT

A multiple-orifice nozzle that is employed for creating surface-adhesive rules onto the surface of a surface-adhesive die. The multiple-orifice nozzle is fluidly in communication with a source of flexible material that is forced or pulled through a selected orifice profile. The orifice profile can be selected based on a variety of criteria and, in some embodiments the orifice profile can be dynamically adjusted or controlled by adjusting the relative position of the multiple-orifice nozzle and/or by adjusting the position of one or more tubes that define various orifices such that the orifice profile is modified.

32 Claims, 16 Drawing Sheets

(56) References Cited

U.S. PATENT DOCUMENTS

| | | | | |
|---|---|---|---|---|
| 6,129,040 | A | 10/2000 | Viggiano et al. | |
| 6,261,367 | B1 * | 7/2001 | Donges | B05C 5/0225 118/300 |
| 7,377,979 | B2 | 5/2008 | Sakayori et al. | |
| 7,708,211 | B2 | 5/2010 | Maier et al. | |
| 7,762,088 | B2 * | 7/2010 | Fiske | B05C 5/001 62/3.64 |
| 2007/0175175 | A1 * | 8/2007 | Schwenke | H05B 3/86 52/745.19 |

* cited by examiner

A-A section view of FIG.1a

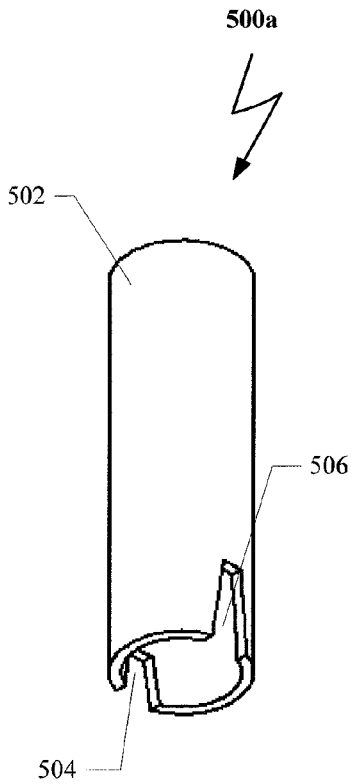
FIG.5a
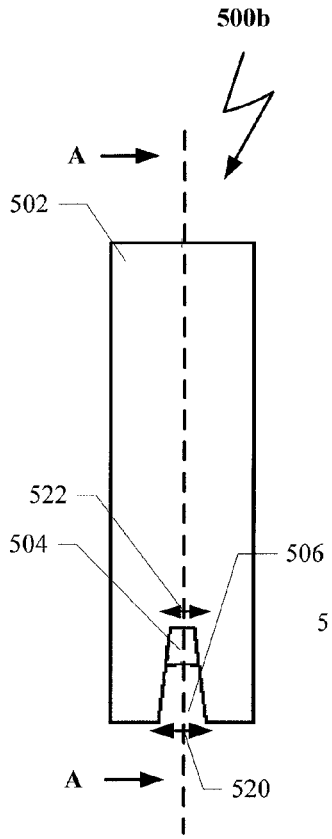
FIG5.b
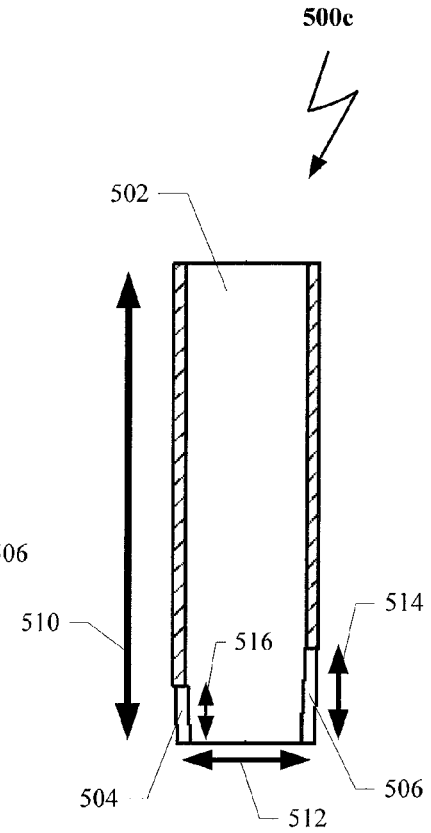
FIG5.c
Section view A-A of FIG.5b

FIG7.b

A-A section view of FIG.7b

METHOD AND SYSTEM FOR A MULTIPLE-ORIFICE NOZZLE

CROSS-REFERENCE TO RELATED APPLICATIONS

This application is Patent Cooperation Treaty application being filed in the Israeli Receiving Office claiming the benefit of the prior filing date of the U.S. provisional application for patent that was filed on Sep. 4, 2011 and assigned Ser. No. 61/531,007, which application is incorporated herein by reference in its entirety.

Other applications that are related to this application and include information that can help gain a better understanding of various embodiments presented herein include: U.S. application bearing the title of "Flexible material for surface adhesive rule" having Ser. No. 13/108,312; U.S. non-provisional application bearing the title of "Method and system for surface adhesive rule technology" having Ser. No. 13/108,389; U.S. application bearing the title of "Method and system for creating co-layer surface adhesive rule" having Ser. No. 13/108,450; U.S. application bearing the title of "Method and system for creating surface adhesive rule counter die" having Ser. No. 13/108,526; and "Method and system for surface adhesive rule technology" assigned the Serial No: PCT/IL 2011/000389. Each of these items are incorporated herein by reference.

TECHNICAL FIELD

The present disclosure generally relates to die-cutting/creasing industry, and, more particularly, the disclosure relates to a system and method of manufacturing die-cutting/creasing for pre-treating cardboards/papers.

BACKGROUND ART

The rapid evolution of trade around the world (globalization) creates a significant demand for packaging in order to transfer/distribute goods to different remote areas. The transport of goods may be done by: ship, airplanes, trucks, and so on. The transport of goods may be performed by: the manufacturer; different suppliers; individual persons; etc. Further, a significant demand for different brochures, flyers, etc., also takes part in trade. The different brochures/flyers may have pre-folds and/or embossing, for example. Embossing such as, but not limited to Braille writing.

Packaging of products for shipping, display and protection takes on a major role in the market today. The package in which the goods are packed and presented, in a store for example, may determine if the goods will be appealing to a potential buyer in the store or not. Thus the packaging appearance can have a direct effect on the sales of merchandise. The brochures, flyers, and so on may also contribute to the sales/awareness with regards to a product and/or service etc.

Henceforth, throughout the description, drawings and claims of the present disclosure, the terms package, paperboard box, parcel, box, carton box, cardboard box, brochure, flyers, etc. may be used interchangeably. The present disclosure may use the term package as a representative term for the above group as well as variants thereof.

A known preliminary requirement, in order to construct a package, is preparing or purchasing a pre-treated cardboard and/or paper based material. Paper based material may be of different types. Exemplary types may be: waxed paper, cartridge paper, art paper, etc. Henceforth, throughout the description, drawings and claims of the present disclosure, the terms cardboard, card-stock, display board, corrugated fiberboard, paperboards of different paper based material, folding boxboard, carton, blanks, plastic sheet, film, and so on, may be used interchangeably. The present disclosure may use the term cardboard as a representative term for the above group.

The pre-treatment of a cardboard may include the following acts: creating folding lines along the cardboard to ease or assist in the folding of the cardboard and provide accurate folding of the cardboard; piercing the cardboard in different areas; creating embossments in different areas of the cardboard; cutting the raw cardboard into predefined profiles; and so on. Henceforth, throughout the description, drawings and claims of the present disclosure, the terms pre-folded cardboard, and pre-treated cardboard may be used interchangeably. The present disclosure may use the term pre-treated cardboard as a representative term for the above group.

Some common techniques for preparing a pre-treated cardboard include the acts of placing the cardboard between dies. Known dies include a steel-rule die and a counter-die. The steel-rule die may include a variety of different types of dies. Exemplary types of dies can be: a cutting-die; a creasing-die; an embossing-die; a scoring-die; a combination of the different types of dies; and so on. The steel-rule die body is usually a hard-wood-based material. Exemplary hard-wood-based material may be: plywood, maple wood, etc. Other exemplary materials for construction of the steel-rule die body may be: plastic, metal, fabric, etc. The body material is required to have a high-dimension stability and a high-grade and be without voids or other imperfections.

Jammed deeply and firmly into a plurality of pre-made slots inside the steel-rule die's body is a plurality of steel-rules. The pre-made slots hold the steel-rules in place during the production of the steel-rule die. Further, the pre-made slots support the steel-rule during the operation of the cutting/creasing/embossing of numerous cardboards. The steel-rules are usually cut and bent blades made of hardened steel, for example. Usually, around the steel-rules, a plurality of ejection (rebound) rubbers needs to be placed and glued. Without the ejection rubber the cardboard may tend to get stuck amongst the steel rules.

The counter-die comprises a body. The body is usually a hard-wood-based material. Other exemplary material may be: plastic, metal, fabric, etc. Commonly, a plurality of trenches is grooved in the counter-die. The location and structure of the trenches is required to fit precisely to the location and structure of the steel-rules of the steel-rule die.

Known common techniques of manufacturing steel-rule dies include the acts of: preparing slots in the die's body (the wood for example) for the steel-rules. This is commonly done by a station using lasers or a special handsaw, for example. Next a specialist cuts and bends the steel rule and positions them into the slots in the body of the die. Typically, the specialist is a highly trained technician that has spent considerable time learning the trade. The positioning requires hammering the steel-rules deeply into the slots. Adjustments of the height of the steel-rule protruding from the body of the die are usually required as well. A specialist will then need to glue a plurality of ejection rubbers around the steel-rules.

Known common techniques of manufacturing the counter-dies include several actions. For example, during the production of the counter-die one or more inexpensive materials (often referred to as inserts) may be associated to the counter-die's body. The inserts may be associated to the body by screws, nails, re-positional adhesive, etc. The inserts may be made of phenolic-resin, paper, fabric, as non-limiting examples. The inserts may include grooves or trenches in it. The inserts are positioned so that their grooves/trenches are aligned/centered with the corresponding steel-rules of the steel-rule die. The alignment/centering of the inserts is usually performed by a specialist.

A trial cutting/creasing/embossing operation can then be made between the steel-rule die and the counter-die, together with a sheet of paper-based material between them, for example. If the alignment/centering is not satisfactory, the specialist detaches the inserts from the counter die and re-positions them. If the alignment/centering is satisfactory, the specialist can groove trenches in the counter die's body precisely where the trenches of the insets were and detach the inserts from the body. In alternate embodiments, the inserts with the trenches may be left on the counter die's body and act as the trenches.

SUMMARY OF DISCLOSURE

When pre-treating a cardboard, such as but not limited to, creating a crease line, there may be an importance to the direction of the crease line created and the direction of the fibers of the cardboard being pre-treated. The quality of a crease line created lengthwise or substantially parallel to the direction of the fibers of the cardboard may differ from the quality of a crease line created perpendicularly to the direction of the fibers when using a similar creasing rule, for example. The above may be true for creating cutting, embossing, creasing, etc.

Therefore in some exemplary embodiments, rules with different profiles (attributes, profiles, etc.) may need to be used to create a similar crease for different locations and/or directions of the created creases and orientations of the product being creased and the grain of fibers within such product. Exemplary rule profiles (attributes) may be: height of the rule, profile of the rule, width of the rule, shape of the rule, geometry of the rule, sharpness, dimension, a combination of two or more of these, as well as other attributes. The requirement for different profiles or attributes is generally true for cutting, embossing, creasing, etc. a product. Henceforth, throughout the description, drawings and claims of the present disclosure, the terms profile, attributes, etc. may be used interchangeably. The present disclosure may use the term profile as a representative term for the above group.

Exemplary diverse requirements of rule profiles (attributes) according to their placement in relationship to the orientation of the cardboard and the grain and/or direction of the fibers of the cardboard, may be a different height and/or sharpness and/or shape. As a non-limiting example, a higher/narrower/sharper creasing rule may needed for creating a crease line lengthwise or substantially parallel to the direction of the fibers of a cardboard than what may be needed for creating a crease line perpendicular to the direction of the fibers; and so on. These embodiments may require a complex assembly that may require fine-tuning, and may be time consuming, and expensive if done using the common steel-rule die industry. Taking into consideration the fact that if a steel-rule die is not assembled correctly, a new die may need to be made. Having to engage in such activities will result in increasing the time to market and expenses associated with producing products.

Furthermore, different types of cardboard may require different profiles of rules (attributes). For example, a thick cardboard (0.6 mm, for example) may require a different rule profile for a creasing/cutting/embossing rule than what may be required for a thinner cardboard (0.3 mm, for example); and so on. The material of the cardboard may also require different profiles of rules. Different material, such as but not limited to: laminated areas of a cardboard may require different profile of the rule, and so on. Further, in some applications the material being processed may be a hybrid of different thickness, texture, rigidity, elasticity, etc., and as such, different attributes may be required for different areas of the material.

Another exemplary rule profile (attributes) that may be required when creating a crease line lengthwise or substantially parallel to the direction of a cardboard's fibers, may be a combinational rule profile. A combinational rule may be a rule that is partially a cutting rule and partially a creasing rule, for example. For example a combinational-rule profile may alter from a cutting rule profile to a creasing rule profile every few millimeters (5-10 mm, for example). To provide the functionality of a combination-rule profile may require a complex assembly that may require fine-tuning, and may be time consuming and expensive if done using the common steel-rule die technique. Also, taking into consideration that if not assembled correctly, a new die may need to be made. Such requirements will further increases time to market and expenses associated with producing products. Combinational rules may be used for different reasons and needs, such as embossing as a non-limiting example.

Furthermore, in cylindrical/rotary systems (system that comprise drums, for example) that are used for pre-treating cardboards and/or for creating cutting/creasing/embossing dies, there may also be a wide diversity of requirements for the rules profiles in accordance to their location on the die. For example, there may be a different rule profile (attributes) requirement for a rule located perpendicular to the drum's circumference than for the rule profile (attributes) requirements for a rule located parallel to the drum's circumference, and so on. Exemplary rule profile (attributes) requirements may be: the height of the rule, the profile of the rule, the width of the rule, a combination of two or more of these requirements, as well as others.

Exemplary diverse requirements of rule profile (attributes) according to their placement in relationship to a cylindrical/rotary system's drums may be: rules located perpendicular to the circumference of the drums may require a wide base and/or shoulder-like profile; and so on.

Other Exemplary diverse requirements of rule profile (attributes) may be: rules located very close to one another may require a narrower profile and/or narrower base, and so on. Satisfying these requirements may result in the need for a complex assembly that may require fine-tuning, and may be time consuming, and expensive if done using the common steel-rule die technology. Taking into consideration that if not assembled correctly, a new die will need to be made. Such requirements will further increase the time to market and expenses for producing a product.

Another exemplary technique may be by creating different trench profiles in the counter die. Different trench profile (trench-attributes) such as, but not limited to: deeper grooved trench opposite to the rules that will be used for pre-treating the cardboard lengthwise to its fibers, and so on. These requirements may result in the need for a complex assembly that may require fine-tuning. Thus, satisfying these requirements may be time consuming and expensive if done using the common steel-rule die technology.

The above-described deficiencies in common die-cut/crease/emboss industries do not intend to limit the scope of the inventive concepts in any manner. They are merely presented for illustrating an existing situation.

Among other things, the present disclosure provides a novel system, apparatus and method for a multiple-orifice nozzle that may be implemented in a surface-adhesive-rule technology (SART). A surface-adhesive-rule technology (SART) enables the rules to be adhered to the surface of the body of the die. The rules of the surface-adhesive-rule technology (SART) may include a variety of different types of rules. Exemplary types may include: cutting rules; creasing rules; embossing rules; etc. Henceforth, throughout the description, drawings and claims of the present disclosure, the terms cutting rules, creasing rules, embossing rules, etc. may be used interchangeably, not from a functional perspective but, from the perspective in which embodiments or configurations that are described with relationship to one particular type of rule, could actually utilize any of the variety of types of rules. Further, the present disclosure may use the term rule as a representative term for the above group.

In exemplary embodiments, including some of the embodiments described in the present disclosure, surface-adhesive rules (SAR) of the SART may be made of flexible-material. The flexible material may be a liquid or gel like material. The flexible-material may be a ceramic composite paste, and/or a metallic composite paste, and/or a composite solder paste, or a combination of these and others. The flexible-material may include one or more different types of polymers or even different combinations of differing types of polymers. Exemplary polymers that may be used may include: polyester, polyamide, polycarbonate, polyurethane, acrylic, polypropylene, polyethylene, etc. Furthermore, the flexible-material may include one or more additives. These additives may include, but are not limited to: silica, ceramics, metal, various fibers, different fillers, etc.

In some embodiments the flexible material of the SAR may be: thermoplastic polymers, thermosetting polymers, metal, a combination of any of these as well as other materials. Exemplary flexible material may comprise different physical properties such as, but not limited to, a hardness of 60-99 shore A, preferably hardness of 80-99 shore A, as well as other physical properties. Optionally, the viscosity of the material as deposited (drawn) may be between 1,000 cps and 145,000 cps and, in some embodiments, between 17,000 cps and 80,000 cps, etc. Other characteristics that may be included in the deposited material may include phase change material, surface tension, adhesion, tackiness, as well as other characteristics.

In some embodiments, such as when the SAR type is a cutting SAR, the edges of the SAR may be milled and/or ground in order to form a sharpened edge adapted for cutting. The milling and/or grinding may be done by mechanical or optical equipment. Exemplary materials that may be used for the milling and/or grinding include: polymers loaded with glass fiber, carbon fiber, Kevlar fiber or fillers like silica, metal, carbon black etc.

The flexible material may be liquid, and/or semi-solid, and/or phase change, material and/or gel like material, etc. Henceforth throughout the description, drawing and claims of the present disclosure, the term flexible material may be used as a representative term of the above group. The flexible material of the SAR may have additional attributes (attributes). Exemplary attributes may include the ability of the flexible material to reserve or maintain the required surface-adhesive rule (SAR) profile while drawing the SAR on the surface-adhesive-rule die's body (SARD) surface. As a non-limiting example, the attributes of the flexible material may be such that the shape and size of the surface-adhesive rule (SAR) profile is within plus or minus a few percentages (between 5-15 percent) from the profile of an orifice of a nozzle through which the flexible material is deposited, ejected (drawn) as a SAR for a period of a few seconds to a few hours. In other exemplary embodiments the reserve the required surface-adhesive rule (SAR) profile may be plus or minus a 10-30 percentage replication of the profile of the orifice from the profile of the profile (i.e. for a few minutes to tens of minutes, for example).

In some embodiments, the flexible material of the surface-adhesive rules (SAR) may include multiple layers (co-layer). In some application, each such layer may be made of different materials. Further, in some applications, each layer may also have a different: profile; cross-section; width; comprise different polymer types and/or additives; etc. In addition, each layer may have a different required attribute. For example, the lower layer may be required to have better adhesive attributes, the highest layer may be required to have more elastic attributes, and so on.

In exemplary embodiments, the SAR (surface-adhesive rule) profile may comprise different attributes. Exemplary attributes of the SAR may be: a wide base, a non-symmetrical profile, a cone profile, straight profile, and different combination of these attributes as well as others. It will be appreciated that depending upon the type of manipulation required for a particular cut, crease, fold, etc., the profile and attributes of the SAR may be determined according to different required parameters. These parameters may include, but are not limited to: the layout of the surface-adhesive-rule die (SARD); the distance between different SARs; the direction from which harsh forces will strike the SARs; the adhesive requirements; the relation between the location/direction of the rule and the cardboard fibers, the relation between the location/direction of the rule in accordance to the system, etc. In some exemplary embodiments, the environmental terms may also carry weight in determining the required orifice profile. Exemplary environmental terms may be: temperature, humidity, etc.

An exemplary embodiment of the surface-adhesive-rule technology (SART) enables a complete surface-adhesive-rule die (SARD) to be automatically created, while simultaneously drawing its plurality of surface-adhesive rules (SARs). Exemplary embodiments of the system and method of the surface-adhesive-rule technology may include a rule-drawer. The rule-drawer may operate to automatically draw the surface-adhesive rules (SARs) onto the surface of a surface-adhesive-rules die (SARD) body at the required locations. The process of drawing the rules may comprise one or more of the following actions: create the SAR; lay the SAR; adhere the SAR onto the surface of the SARD's body, etc. The drawing of the SARs may be done in a continuous motion, in a segmented motion, and/or a combination of both motions as well as a variety of other techniques.

An exemplary embodiment of a rule-drawer may comprise: one or more drawing-heads, a controller, and a leading mechanism. The drawing-head may be an automatic drawing-head associated with the leading mechanism. The leading mechanism, under the direction of the controller, may operate to move elements of the drawing-head to different locations and in different directions, for example. The leading mechanism may be a mechanical arm, one or more rails, a grid wire or any other mechanism that can reliably move the drawing-head to a particular position, orientation and/or at a particular rate of movement. The controller may control the drawing head as well as the leading mechanism, for example. For instance, the controller may operate to cause the leading mechanism to move the drawing head to a desired location, and then trigger the drawing head to begin drawing (outputting or extruding the flexible material, for example).

The controller may be integral to a computer (such as software, firmware etc). Software may be embodied on a computer readable medium such as a read/write hard disc, CDROM, Flash memory, ROM, or other memory or storage, etc. In order to execute a certain task, a software program may be loaded into memory or otherwise be accessible to an appropriate processor as needed or operated by a computer, for example.

As a non-limiting example of the controller being integral to a computer, the computer may be loaded with a job description. The job description may include: the type of the surface-adhesive rules (SAR), the type and thickness of the cardboard, the layout of the surface-adhesive-rule die (SARD), the direction of the fibers of the cardboard to be pretreated, the direction of a system drums movement, the environmental conditions, etc.

The layout of the SARD may include, the placement of each SAR, the type of each SAR (cut/crease/emboss etc.), the required rule profile (rule attributes) for each SAR, etc. Accordingly, the controller may command and automatically control the leading mechanism and/or the drawing head of the rule-drawer for drawing the SARs on the surface of the SARD's (surface-adhesive-rule die) body. The controller may control other modules of the surface-adhesive-rule technology (SART).

The computer of the SART may further comprise a look-up table. The look-up table may comprise different information. Exemplary information may include, but is not limited to: information regarding the surface-adhesive rule's profile for different types of SARs (cut/crease/emboss); information regarding the required ingredients for the flexible material for a required cardboard; the information regarding the required ingredients for the flexible material for a required function (cutting/creasing/embossing); the required profile for different types of rules according to their placement; the nozzle required for a job; the orifice of a nozzle required for the job, as well as other information that may be necessary to properly lay the SAR.

In an exemplary embodiment, the drawing-head or drawing-heads of the rule-drawer may include or may interface to a cartridge. Although the description may refer to a single drawing-head, it should be appreciated that in various embodiments, more than one drawing head may be utilized. The cartridge interfaced to the drawing-head may contain the flexible material used to create a SAR. The drawing-head may further comprise a multiple-orifice nozzle with one or more predefined orifice profiles. The inside of the cartridge may have a coating that operates to reject or repel the flexible material out of the cartridge. Advantageously, this characteristic promotes to flow of the flexible material toward the multiple-orifice nozzle. The selected orifice's profile may determine the surface-adhesive rule profile. The orifices may be located at the bottom of the nozzle, at the peripheral of the nozzle, on an edge of the nozzle, or a combination of multiple placements, etc.

The profile and placement of the orifice may be determined according to different criteria. Non-limiting examples of these criteria may include: adhesive requirements of the SAR to the surface of the SARD's body; the drawing-termination technique used; the required surface-adhesive rule profile as well as other criteria. In addition, the angle and height of the nozzle may be determined according to different criteria. Non-limiting examples of these criteria may include: the orifice location; the flexible material of the SAR; and the distance from an adjacent SAR. In exemplary embodiments, the angle and height may change during the drawing of the SARs.

The inside of the multiple-orifice nozzle may include a coating that operates to reject/repel the flexible material. Advantageously, this characteristic helps to prevent or alleviate, either partial or complete clogging or blockage of the orifice. The profile and placement of the orifice may be determined according to different criteria. In exemplary embodiments, a multiple-orifice nozzle may be quickly and easily disassembled or detached from the drawing-head and a different multiple-orifice nozzle may be assembled or attached to the drawing-head. The orifices of the multiple orifice nozzle may be similar in shape and may function as a back up for different cases. Different cases may be: redundancy, wear of one or more of the orifices, blocking of one of the orifices, etc.

In some embodiments, the drawing-head may include a pressure-actuator or may be coupled to a pressure-actuator. In such embodiments, the pressure-actuator facilitates the dispensing of the flexible material out of the cartridge and through the selected or active orifice of the multiple-orifice nozzle. The flexible material is dispensed toward the required placement on the surface of the die's body, thereby creating the surface-adhesive rule and die.

The pressure-actuator employed in various embodiments may be of different types. Exemplary types of the pressure-actuator may include, but are not limited to: an air-pump actuator to create a positive or negative (vacuum) air pressure, a screw-pump actuator, a piston actuator, an electrical pump actuator, a cogwheel actuator, an inject actuator etc. Thus, the pressure actuator can operate to push flexible material from the cartridge or to pull flexible material from the cartridge. In some exemplary embodiments, a pressure-actuator is not used. Rather, the flexible-material is dispensed based primarily on gravitational forces. In addition, other forces can operate to assist in the dispensing of the flexible material from the cartridge. For instance, the tackiness of the flexible material to the surface of the die may operate, together with the relative movement of the die and the nozzle, to pull or draw the required amount of flexible material out of the cartridge. In addition, the surface tension between the flexible material and the surface of the die may operate, together with the relative movement of the die and the nozzle, to pull or draw the required amount of flexible material out of the cartridge. It should be appreciated than in various embodiments, any of the afore mentioned techniques for dispensing the flexible material, as well as a combination of two or more of the listed techniques may be employed. It should also be appreciated that in embodiments that utilize a pressure-actuator, one of the afore mentioned techniques, as well as other techniques or a combination of two or more types of pressure-actuators may be utilized. There may be one or more pressure-actuators associated with one or more modules of the rule-drawer, for example.

It will be appreciated that between uses or while processor or working on a die that is being created, there can be periods of time in which the drawing head is idle (i.e., no flexible material is being dispensed). During such times, it is advantageous to prevent the flexible material from hardening or from being exposed to the air. Thus, in some embodiments, a method and apparatus to isolate the flexible material that has not yet been placed onto the surface of the die (i.e., flexible material remaining in the cartridge and multiple-orifice nozzle) from being exposed to air. As a non-limiting example, a cover may be positioned so as to cover the cartridge/multiple-orifice nozzle when they are not in use.

In yet other embodiments, a self-maintained-cleaning mechanism may be incorporated. The self-maintained-cleaning mechanism may be a part of the rule-drawer, such as an additional cartridge that stores cleaning material, for example. In other embodiments, the self-maintained-cleaning mechanism may be external to the rule-drawer. The self-maintained-cleaning mechanism may work at pre-defined times and/or when needed to prevent the clogging of the orifice or simply to prepare it for continued use.

More information on the surface-adhesive-rule technology (SART) and the surface-adhesive rules (SAR) flexible material, may be found in related U.S. applications bearing the title of "Flexible material for surface adhesive rule" having Ser. No. 13/108,312; U.S. non-provisional application bearing the title of "Method and system for surface adhesive rule technology" having Ser. No. 13/108,389; U.S. application bearing the title of "Method and system for creating co-layer surface adhesive rule" having Ser. No. 13/108,450; U.S. application bearing the title of "Method and system for creating surface adhesive rule counter die" having Ser. No. 13/108,526; and "Method and system for surface adhesive rule technology" assigned the Serial No: PCT/IL 2011/000389. The above applications are incorporated herein by reference in their entirety.

One aspect that may be incorporated into various embodiments is a novel multiple-orifice nozzle that enables drawing a variety of different profiled rules using the same multiple-orifice nozzle. Advantageously, the employment of this nozzle in various embodiments can operate to reduce complexity, expenses, and process time in the creation of dies.

An exemplary embodiment of a multiple-orifice nozzle includes a nozzle with two or more orifices on the peripheral of the nozzle. More specifically, in some embodiments, the multiple-orifice nozzle may include at least one orifice at a predefined area on the bottom of the nozzle. For instance, the bottom of the multiple-orifice nozzle may be the area/part of the nozzle that faces the die when the nozzle is being used to draw the rules on the surface of the die. In some embodiments one or more of the peripheral orifices, together with one or more of the bottom orifices, create a continuous opening.

In some exemplary embodiments, each orifice of the multiple-orifice nozzle may have a different profile. Thus, the SARs drawn from each orifice will have a different profile (attributes). The attributes of the SARs may include, but are not limited: height, width, cross section profile, etc. Exemplary profiles of the one or more orifices of the multiple-orifice nozzle may be: rectangular, triangular, a trapezoidal, etc. The one or more orifices at the bottom of the multiple-orifice nozzle may be used, among other functions, to enable using the required peripheral orifice for a required SAR, for example. Exemplary profiles for the orifices at the bottom of the multiple-orifice nozzle may be: an opening profile similar to the nozzle's profile; a circle; a square; a rectangle; a bone-like profile; etc. The size of the orifices at the bottom of the multiple-orifice may be similar to the size of the nozzle; different from the size of the nozzle; etc.

When required to draw a SAR with a profile that may be achieved by one of the peripheral orifices of the multiple-orifice nozzle, for example, the multiple-orifice nozzle may be directed such that the required peripheral orifice be placed in a direction opposite to the direction of the multiple-orifice nozzle's movement. Thus, the flexible material will be deposited and pulled through the required peripheral orifice. In embodiments were the die is moving and the nozzle is stationary, then the multiple-orifice nozzle may be directed such that the required peripheral orifice be directed in a direction similar to the direction of the moving die. Thus the flexible material will be deposited and pulled through the required peripheral orifice. In yet other embodiments a combination of the above techniques may be implemented thus, the nozzle and the die may be moved in substantially opposing directions at the same or at different rates.

In some embodiments there may be no orifice at the bottom of the multiple-orifice nozzle. Further, in some embodiments the multiple-orifice nozzle may be tilted at angle such that the required or active orifice is closer to the die surface than the other orifices of the multiple-orifice nozzle. In yet other embodiments, a combination of the above techniques may be implemented. In some embodiments tilting the multiple-orifice nozzle may also include temporarily applying heat to the flexible material to temporarily reduce the viscosity of flexible material.

As an operational example, when selecting a particular profile for a SAR, or when switching from one profile to another when a different profile (attributes) SAR is required to be drawn, the multiple-orifice nozzle simply needs to be rotated or otherwise directed such that the appropriate peripheral orifice is placed opposite to the direction of movement of the multiple-orifice nozzle and/or similar to the direction of the movement of the die (or where appropriate, a combination of both). At this point, the drawing of the SAR or the next SAR can commence. As will be appreciated by one of ordinary skill in the art, the ability to select or change the profile of a SAR as presented, greatly simplifies the process of creating a die by reducing or eliminating the need to replace nozzles, and further, operates to reduce the costs and time for creating a die.

Another feature that can be incorporated into various embodiments is not only the ability to move the nozzle such that different orifices are selected, but to also move the nozzle such that the orientation of an orifice can effect the manner in which the flexible material is deposited onto the die. For example, a selected peripheral orifice may be directed such that only a portion of it is in the opposite direction of the movement of the multiple-orifice nozzle when the SAR is being drawn (i.e., the opening is skewed relative to the direction of movement). By orienting the orifice in this manner, it enables the orifice to draw a SAR with a narrower profiled rule than what would be realized by a non-skewed orifice. Thus, it will be appreciated that such a function allows the same orifice to be utilized to draw SARS having different profiles. Similarly, the orifice can be skewed upward or downward to create a SAR with a profile of a different height.

Another feature or variation of the multiple-orifice nozzle may include an external tube and an internal tube that share a similar axis or are coaxial. The external tube may include one or more peripheral orifices while the internal tube may have no peripheral orifices in some embodiments. Exemplary profiles of the one or more orifices of the external tube may be: rectangular, triangular, trapezoidal, etc. While the internal tube may have no orifice at it's peripheral. The internal tube may have an opening at its bottom. When drawing a rule with a required profile (attributes), the internal tube may be elevated or lowered to a required height thus enabling the flexible material to be output through a predefined exposed area of one of the peripheral orifices of the external tube. For different heights of the internal tube, different profiled SARs may be drawn. In other exemplary embodiments, the internal tube may comprise one or more orifices while the external tube comprises no orifice, thus the elevation of the external tube may determine the height and shape of the exposed orifice of the internal tube.

In some exemplary embodiments, the external tube may have more than one peripheral orifice. Thus, a combination of the height of the internal orifice together with the placement and direction of the nozzle may enable drawing of a plurality of different SAR profiles. Further, in some exemplary embodiments, the internal tube may have one or more peripheral orifices. Thus, a combination of the internal tube peripheral orifice and the external tube peripheral orifice together with the placement and direction of the nozzle may create a plurality SAR profiles as well.

Exemplary embodiments of the multiple-orifice nozzle with the external and internal tube and a bottom orifice with a predefined area may be used. Exemplary profiles for the orifices at the bottom of the multiple-orifice nozzle may be: an opening profile similar to the nozzle's profile; a circle; a square; a rectangle; a bone-like profile; etc. The size of the orifices at the bottom of the multiple-orifice may be similar to the size of the nozzle; different from the size of the nozzle; etc. More information is disclosed below in conjunction with the figures.

Further, the multiple-orifice nozzle with the external multiple-orifice nozzle and internal nozzle may be used for a quick and simple way to draw a combinational surface adhesive rule (SAR). The combinational SAR may require a partially sharp edge (triangle profile for example) and a partially blunt edge (trapezoid profile, for example), for example. The external tube of a multiple-orifice nozzle may comprise a peripheral orifice in the profile of a triangle, for example. The internal tube of the multiple-orifice nozzle may have no peripheral orifice.

When drawing areas of the combinational SAR that are required to have a sharp edge, the internal tube may be lifted such that the whole peripheral orifice area of the external tube is exposed. Thus, the flexible material is output through the triangle-liked profiled orifice. When drawing areas of the combinational SAR that are required to have a blunt edge, the internal tube may be lowered such that only the lower area of the peripheral orifice of the external tube is exposed. Thus, the flexible material is output through a trapezoidal-liked profiled orifice. The above method and system may be utilized to create combinational SARs of embossing, cutting, creasing SARs and a combination of them, for example.

Even further, when required to end the drawing of the SAR, the internal tube may be lowered sharply down to the surface of the die in parallel to stopping the delivery of the flexible material by stopping pressure by the pressure actuator. The multiple-orifice nozzle may further be span sharply around it center at an angle (180 degrees, for example).

Various embodiments of a system to create dies may utilize one or a combination of the different methods and or multiple-orifice nozzles described above. Exemplary embodiments of the multiple-orifice nozzle may be utilized for different system requirements. For instance, the requirements in a system may include: the ability to create a die with a plurality of different types of surface-adhesive rules (cutting/embossing/creasing); the ability to create surface-adhesive-rule dies to be used with different cardboard types (different width of cardboard, material of cardboard, etc); the ability for one or more combinational SARs to be created; the ability to create a die and its SARs in a cylindrical/rotary system; the ability for the SAR profile to be created according to or relative to the direction of the cardboard fibers; the ability to create a SAR profile suited to different material being pretreated, such as but not limited to plastic; etc.

An exemplary embodiment of a SART using one or more multiple-orifice nozzles may use a look-up table. In such an embodiment, the look-up table may include different entries and fields for different settings of the nozzle(s) and other characteristics. For example, the look-up table may include different entries for, the type of cardboard that is to be pretreated by the die; the widths or sizes of the cardboard that is to be pre-treated; the varying direction or characteristics of the fiber of the cardboard to be pre-treated; the varying types or styles of SARs to be created or the purpose of the SAR (i.e, cut/crease/emboss . . . ) for a die's layout; varying distance between different SARs; varying directions of the drum movement; varying ingredients and compositions for the flexible material; varying environmental and age conditions; etc.

For each entry in the look-up table, a plurality of fields may be allocated. Each field may include different information, settings, and/or commands. As a non-limiting example, the information, settings and/or commands may include: the identification of a required orifice profile of a multiple-orifice nozzle; the required direction of movement of the multiple-orifice nozzle; the required height of the internal tube of a multiple-orifice nozzle; the amount of pressure to be applied by the pressure-actuator for drawing each SAR; the velocity of the drawing head for each SAR; the required composition of ingredients for the flexible material; the accelerations/decelerations requirements; the start-up and delays requirements; as well as a combination of the above information, settings and/or commands as well as others.

In various embodiments, a controller of the SART may obtain information, settings and/or command from the look-up table before or during the creation of a die. Accordingly, based on the selected entry in the look-up table, the controller may control: the multiple-orifice nozzle's direction/movement/height/angle; the leading mechanism velocity; the pressure actuator pressure; etc.

In preparations for creating a die utilizing various embodiments of the SART, the method may include: getting a layout of a die including the placements and types of SARs (cutting, creasing, embossing, etc.) required; getting information regarding the type of cardboards to be pre-treated (width, paper, etc.); determining the profile of the SARs in relation to different system parameters. The system parameters may include information such as, but not limited to: the location, the flexible material composition required, angle, gap, of the drums; the placement of the cardboard and the direction of their fibers; etc.

Once this information is obtained, relevant entries and fields of the look-up table may be fetched. Exemplary entries and fields may comprise the following information/commands: profile of each SAR, the distance between each SAR, which orifice of the multiple-orifice nozzle to use for each SAR, the area of the chosen orifice to be exposed for each SAR, the angle and/or direction of the multiple-orifice nozzle for drawing each SAR, the velocity and flow rate required for each SAR drawing, the order in which the SARs will be drawn, etc. The flow rate may be influenced, among other things, by the pressure of the pressure-actuator, for example.

Some exemplary embodiments may change the exposed area of the orifice of a multiple-orifice nozzle during the drawing of a SAR. Thus creating a SAR with a variable profile. This technique may be used to create a combinational rule, or a rule drawn in an arc-like shape for example.

In other exemplary embodiments a combination of different drawing methods may be implemented.

The present novel system and method of multiple orifice nozzle may be utilized in many different industries: die-cuts, glue, dispensing, and so on.

Sizes, dimensions, and profiles of the multiple-orifice nozzles and the orifices may be according to system requirements. Exemplary system requirements may be: the location and angle in relation to the drum's longitude and latitude, the placement of the cardboard and the direction of their fibers, the type of cardboards to be pre-treated, the distance between SARs, etc.

Unless otherwise defined, all technical and/or scientific terms used herein have the same meaning as commonly understood by one of ordinary skill in the art to which the disclosure pertains. In case there is a conflict in the definition or meaning of a term, it is intended that the definitions presented within this specification are to be controlling. In addition, the materials, methods, and examples that are presented throughout the description are illustrative only and are not necessarily intended to be limiting.

Reference in the specification to "one embodiment" or to "an embodiment" means that a particular feature, structure, or characteristic described in connection with the embodiment is included in at least one embodiment of the disclosure, and multiple references to "one embodiment" or "an embodiment" should not be understood as necessarily referring to the same embodiment or all embodiments.

Implementation of the method and/or system of embodiments of the disclosure can involve performing or completing selected tasks manually, automatically, or a combination thereof. Moreover, according to actual instrumentation and equipment of embodiments of the method and/or system of the disclosure, several selected tasks could be implemented by hardware, by software or by firmware or by a combination thereof and with or without employment of an operating system. Software may be embodied on a computer readable medium such as a read/write hard disc, CDROM, Flash memory, ROM, etc. In order to execute a certain task, a software program may be loaded into or accessed by an appropriate processor as needed.

These and other aspects of the disclosure will be apparent in view of the attached figures and detailed description. The foregoing summary is not intended to summarize each potential embodiment or every aspect of the present disclosure, and other features and advantages of the present disclosure will become apparent upon reading the following detailed description of the embodiments with the accompanying drawings and appended claims.

Furthermore, although specific embodiments are described in detail to illustrate the inventive concepts to a person of ordinary skill in the art, such embodiments are susceptible to various modifications and alternative forms. Accordingly, the figures and written description are not intended to limit the scope of the inventive concepts in any manner.

BRIEF DESCRIPTION OF THE DRAWINGS

Few examples of embodiments of the present disclosure will be understood and appreciated more fully from the following detailed description, taken in conjunction with the drawings in which:

FIGS. 5*a-e* are schematic illustrations of simplified diagrams with relevant elements of an exemplary multiple-orifice nozzle of a rule-drawer, according to exemplary teaching of the present disclosure;

FIGS. 7*a-c* are schematic illustrations of simplified diagrams with relevant elements of another exemplary multiple-orifice nozzle of a rule-drawer, according to exemplary teaching of the present disclosure;

DETAILED DESCRIPTION OF EXEMPLARY EMBODIMENTS

Turning now to the figures in which like numerals and/or labels represent like elements throughout the several views, exemplary embodiments of the present disclosure are described. For convenience, only some elements of the same group may be labeled with numerals. The purpose of the drawings is to describe exemplary embodiments and is not for production purpose. Therefore features shown in the figures are for illustration purposes only and are not necessarily drawn to-scale and were chosen only for convenience and clarity of presentation.

Figure 1A:
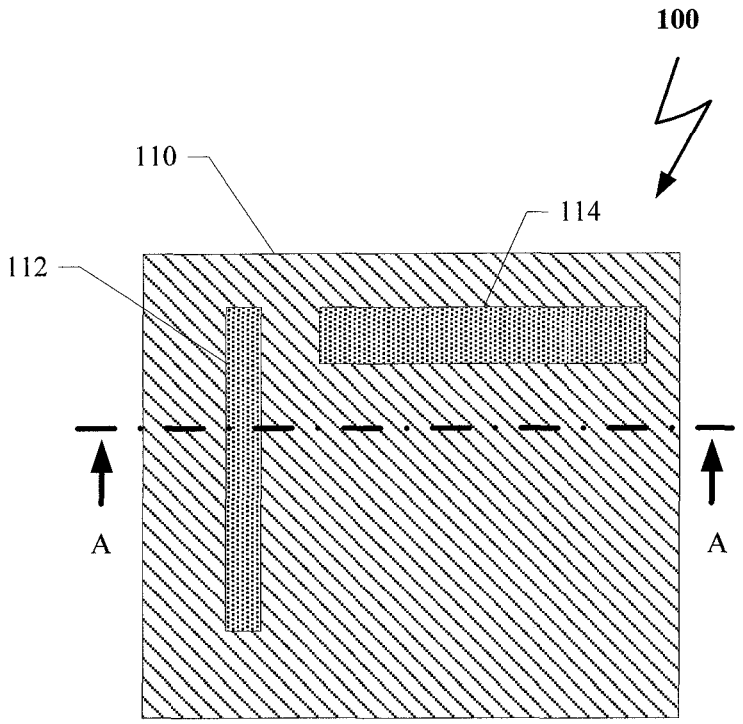
FIGS. 1*a-b* are schematic illustrations of simplified block diagrams with relevant elements of an exemplary surface-adhesive-rule die (SARD), according to exemplary teaching of the present disclosure.

FIG. 1*a* is a schematic illustrating a conceptual simplified portion of a block diagram with relevant elements of an exemplary surface-adhesive-rule die (SARD). The surface-adhesive-rule die 100 (SARD) is illustrated in FIG. 1 as including a body 110, and a plurality of surface-adhesive rules (SAR): SAR 112 and SAR 114, for example. Surface-adhesive rules (SAR) 112 and 114 may be of the same or different types. For instance, the SAR types may be, but are not limited to: cutting SARs; creasing SARs; embossing SARs; combinational SARs; etc. Henceforth, throughout the description, drawings and claims of the present disclosure the terms cutting SAR, creasing SAR, embossing SAR, combinational SAR, etc. may be used interchangeably and the term SAR used by itself may refer to any of these types.

SAR 112 and SAR 114 may be made of flexible material that is drawn onto the surface of the SARD, for example. The flexible material may be a gel or a liquid like material. The flexible material may include one or more different types of polymers and/or different combinations of polymers. Exemplary polymers that may be used include, but are not limited to: polyester, polyamide, polycarbonate, polyurethane, acrylic, polypropylene, polyethylene, etc. Furthermore, the flexible material may include one or more additives. The additives may include, but are not limited to: silica, ceramics, metal, various fibers, different fillers, etc. Thus, the flexible material of the SAR may be: thermoplastic polymers, thermosetting polymers, metal, a combination of any of these as well as others. As a specific and non-limiting example, the flexible material can include polyurethane, having a hardness of 60-99 shore A, preferably, 80-99 shore A or polypropylene, etc. Optionally, the viscosity of the material as deposited (drawn) may be between 1,000 cps and 145,000 cps, preferably between 17,000 cps and 80,000 cps, etc.

In various embodiments, the SAR may include several layers (co layers), and each such layer be constructed from a different material or, one or more layers may be constructed from different materials.

The SARs that are placed or drawn on the die 100 may have a strong enough sustainability, firmness, inside-cohesion, robustness, and/or lifespan to withstand the pressure and harsh operation of a high-pressure press force in one or more directions on the SAR during the cutting/creasing/embossing operation of numerous cardboards. For example, in a typical press, the pressure force exerted by the press may be around a few tons (1-10 ton pressure press force, and/or 50 kg/cm-long for example). However, it will be appreciated that depending on the type and make of the press, and other requirements for operation of the press and generation of pretreated materials, other pressure press forces may be applied.

In some embodiments, a SAR may need to be modified after being laid onto the die. For instance, if a SAR is to be used for cutting, the edges of the SAR may be milled in order to form a modified edge that is more suitable for cutting, for example. The milling of the SAR may be done by one or more of a variety of techniques, including but not limited to, mechanical devices, optical energy, application of chemicals, use of electrical sparks and/or electronic disposition, for example. Exemplary materials that may be used are polymers with additives such as, but not limited to glass fiber, carbon fiber, Kevlar fiber or fillers like silica, metal, carbon black etc.

The exemplary body 110 of the surface-adhesive-rule die (SARD) 100 may be made of/or comprise a flexible film; however it will be appreciated that aspects of the SART presented herein may also be utilized in conjunction with rigid, non-flexible SARD material. Looking at embodiments that employ the use of a flexible film, the film may include one or more types of polymers and/or metal, sheets, compressed carton, paper, etc. Exemplary polymers that may be used to fabricate a flexible film include, but are not limited to: polyester, polyamide, polycarbonate, and/or a combination of one or more of these polymers as well as other polymers and non-polymers. Furthermore, the flexible film may include one or more additives. The additives included in the flexible film may include, but are not limited to: silica, ceramics, metal, different fillers, etc. Exemplary embodiments of the flexible film may have one or more layers and, each layer may utilize or contain a different material than one or more of the other layers. In some exemplary embodiments, the flexible film may be a commercial available one.

The actual composition of the SARD can be changed based on particular needs for the fabrication of certain pretreated material, required life-span of the SARD, expected number of runs that the SARD will be used for, type of material to be processed with the SARD, environment in which the SARD will be utilized or stored, etc. Exemplary flexible films that may be used in the body 110 of a surface-adhesive-rule die 100 (SARD) may include, but are not limited to: PET (Polyethylene terephthalate), PA (Polyamide), polypropylene, stainless steel, Aluminum (Al) and/or a combination of one or more of these materials as well as others. Exemplary suppliers for such materials are: HANITA Company (an Israeli company), SKC Company, ALCAM VAW Company, etc. Some exemplary embodiments of the body 110 of the surface-adhesive-rule die 100 (SARD) may be comprised of a combination of two or more flexible films. Exemplary combinations may include, but are not limited to: 30-1000 micron thickness of PET associated to 30-1000 micron thickness of Al; and/or 30-1000 micron thickness of PA associated to 30-1000 micron thickness of Al; and/or 30-1000 micron thickness of PET associated to 30-1000 micron thickness of PA; and/or 30-1000 micron thickness of PET associated to 30-1000 micron thickness of PA and 30-1000 micron thickness of Al; etc.

The body 110 of the SARD may be associated with, adhered to or otherwise combined with a substrate made of material other then flexible film. These other materials may include, but not limited to: metal, wood, plastic, etc. Furthermore, the body 110 of the SARD may have a flat, cylindrical/rotary or other profile. In addition, the body 110 of the SARD may be flexible such that it's profile can be changed, for example from flat to cylindrical/rotary to be wrapped around a drum, for example.

The body 110 of the SARD may have a strong enough sustainability, firmness, inside-cohesion, robustness, and/or lifespan to withstand the pressure and harsh operation which can be around a few tons of press force (0.1-50 kg/cm-long-SAR, for example) in one or more directions during the cutting/creasing/embossing operation of the cardboards. In other exemplary embodiments, the body 110 of the SARD may be made of material other then flexible film, and/or a combination of various materials.

Figure 1B:
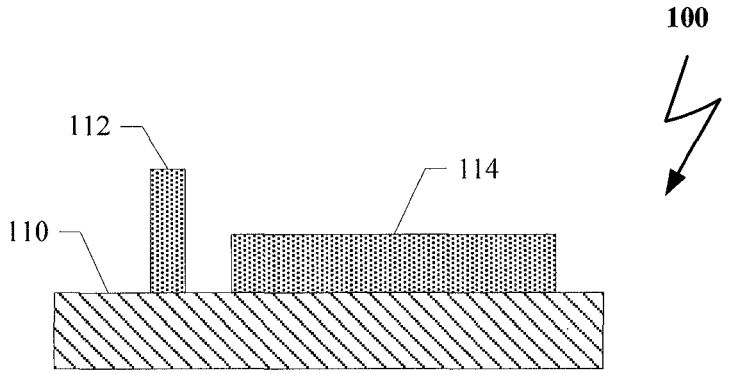

FIG. 1*b* depicts a cross-sectional view of the exemplary surface-adhesive-rule die (SARD) taken at line A-A of FIG. 1*a*. Exemplary SAR 112 and SAR 114 may be bonded to the surface of the body 110 of the SARD by adhesion. Exemplary adhesion techniques may include using an intermediated-adhesive material between the SAR (112 and/or 114) and the surface of the body 110 of the SARD. Intermediated adhesive materials may include, but are not limited to: adcote 811 of DOW company, 238A+catalyst of MORCHEM company, etc. Other exemplary embodiments of adhesion may be achieved by adhesive attributes of the SARs 112 and 114 materials and the materials used in the body 110 of the SARD. Adhesive attributes may include, but are not limited to: epoxy, oligomer, silicone acrylate oligomer, adhesion promoter, photoinitiator. In some embodiments, the bonding may be done by hardening, such as thermal curing, chemical curing, UV curing, etc. Other techniques for bonding the SAR to the SARD may also include welding, fusion, vibration welding, etc. Yet in other exemplary embodiments a combination of the two or more techniques may be implemented and other techniques are also anticipated.

The SARs on the surface of the SARD maybe of different heights, widths and profiles. For instance, FIG. 1*b* shows one SAR 112 this is higher and/or narrower than the other SAR 114. Both SARs may be creasing SARs. The SARs 112 and 114 may be drawn using a multiple-orifice nozzle. The multiple-orifice nozzle may have two or more peripheral orifices. Wherein one of the peripheral orifice profiles is higher than the second peripheral orifice. Thus, drawing a higher SAR 112 that may be used for creasing cardboards along their fiber direction, for example.

Figure 2A:
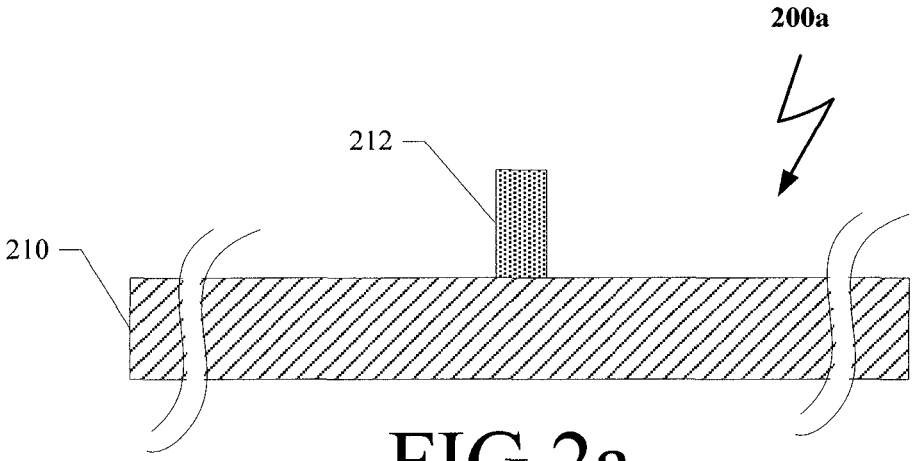
FIGS. 2*a-c* are schematic illustrations a plurality of simplified diagrams with relevant elements of exemplary surface-adhesive-rule (SAR) profiles, according to exemplary teaching of the present disclosure.

FIG. 2*a* schematically illustrates a simplified diagram with relevant elements of an exemplary surface-adhesive-rule die (SARD) 200*a*. The SARD 200*a* may comprise a body 210 and a surface-adhesive rule (SAR) 212. The SAR 212 may be adhered to the surface of the body 210. The SAR 212 may be a creasing SAR and/or a cutting SAR, depending on the cardboard and or SART system. The profile of the SAR 212 may be achieved by the profile of the orifice, of the multiple-orifice nozzle, through which the flexible material has been output through when drawing the SAR.

Figure 2B:
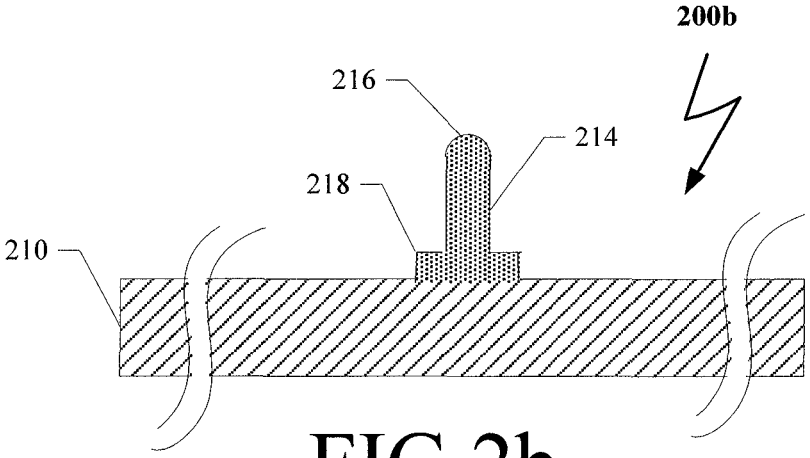

FIG. 2*b* schematically illustrates a simplified diagram with relevant elements of an exemplary surface-adhesive-rule die (SARD) 200*b*, in which the profile of a surface-adhesive rule (SAR) 214 may comprise a wide base 218, and a rounded-profile top edge 216. The wide base 218 may improve the bonding of the SAR 214 to the body 210 of the SARD 200*b*. The wide base 218 and may also enhance the ability of SAR 214 to withstand the forces that may be applied to the SAR 214 during cutting/creasing/embossing operations. The profile of the top edge of the SAR 214 may match the functionality of the SAR 214. For example, the rounded-profile edge 216 may be used for creating crease lines on the surface of a cardboard. The profile of the SAR 214 may be achieved by the selected profile of the orifice of the multiple-orifice nozzle, through which the flexible material has been output when drawing the SAR. However, it will be appreciated that throughout this description, although the creation of a SAR may be described as being extruded through an orifice of a nozzle, the SAR may remain intact as extruded or drawn or, the SAR may be modified or enhanced after being extruded in one of the various ways described herein. Thus, although such additional actions may not be mentioned at each and every point in this description, it should be appreciated that such augmentation may be required or desirable. Thus, in the profile of SAR 214 may initially be drawn as a rectangular shape on the top and, the application of remedial measures may be used to create the rounded upper portion 216.

Figure 2C:
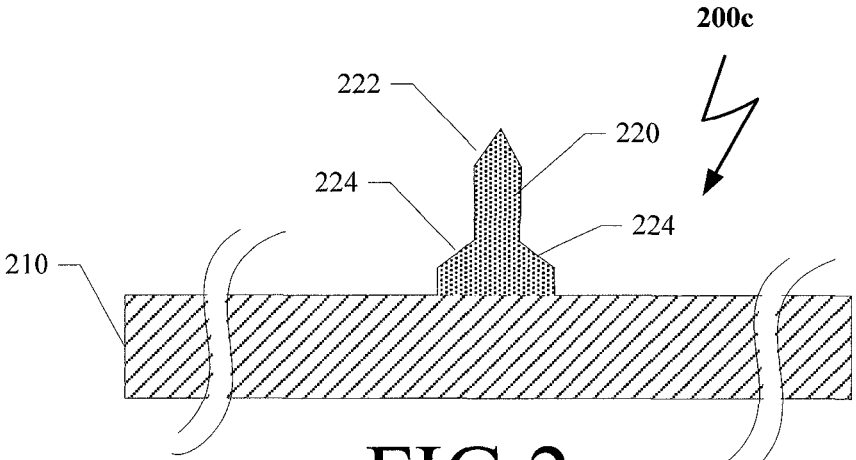

FIG. 2*c* illustrates another exemplary embodiment of a SARD 200*c*. The illustrated SARD 200*c* may comprise a SAR 220 with a sharp top edge 222. The illustrated sharp edge 222 may be used for creating cutting lines on the surface of a cardboard. The SAR 220 may further comprise shoulder-like sides 224. The shoulder-like sides 224 enhance the ability of the SAR 220 to withstand the forces applied to it during cutting/creasing/embossing operations, which forces may originate from different directions. In some exemplary embodiments, the sharp edge may be achieved by further milling (scraping) the edge after hardening the SAR, in other exemplary embodiments the sharp edge may be achieved by the profile of the orifice of the multiple-orifice nozzle through which the flexible material is output. Yet another exemplary embodiment may be a combination of the above.

In some exemplary embodiments the SAR's profile may be a nonsymmetrical profile. Nonsymmetrical profiled SARs may be necessary when two SARs are placed in close proximity to each other on a die. Two or more of the SARs depicted in FIG. 2*a-c* may be drawn by the same multiple-orifice nozzle, utilizing two or more of its orifices. The multiple-orifice nozzle may be similar to the one described below in conjunction FIG. 5 and/or FIG. 7, for example.

Figure 3:
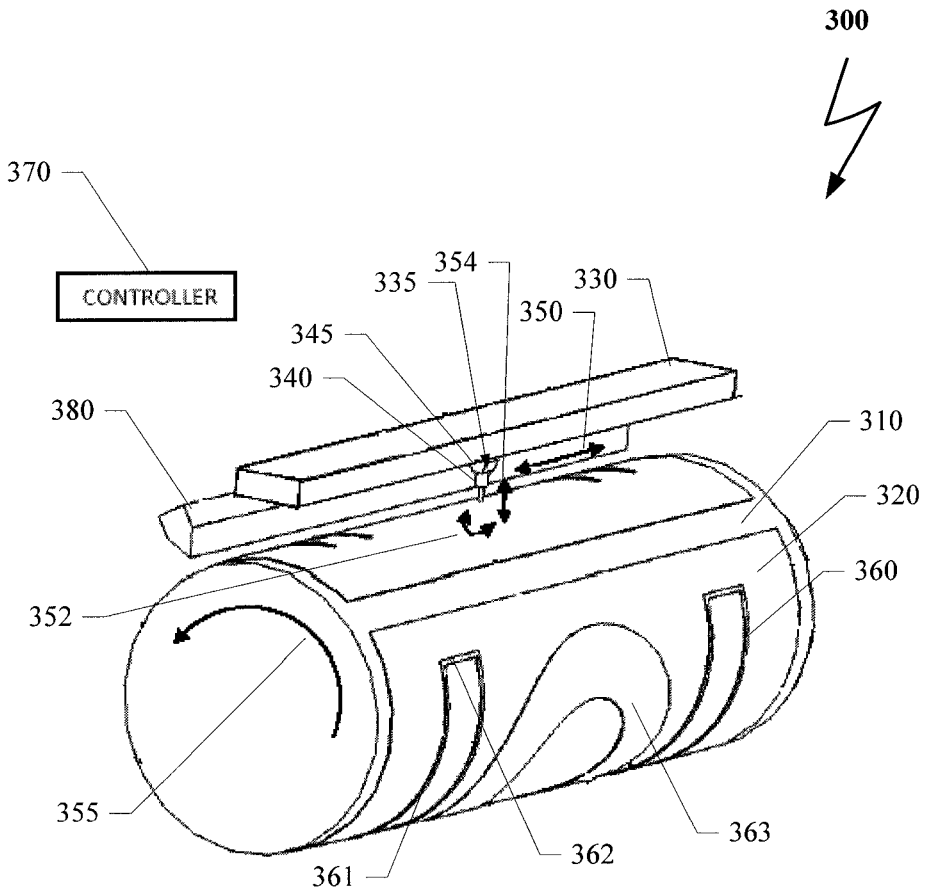
FIG. 3 depicts a schematic diagram with relevant elements of an exemplary surface-adhesive-rule technology (SART) system in accordance with some exemplary embodiments of the present disclosure.

FIG. 3 depicts a schematic diagram with relevant elements of a portion of an exemplary surface-adhesive-rule technology (SART) utilizing a cylindrical/rotary system. The surface-adhesive-rule technology's (SART) cylindrical/rotary system 300 may be used for drawing a plurality of surface-adhesive rules (SAR) 360-363 on the surface of a surface-adhesive-rule die's (SARD) body 320. The SARs 360-363 may protrude from the surface of the SARD's body 320 and may have different profiles. The SARs 360-363 may be functional and configured for cutting, creasing, embossing, etc., and/or a combination of two or more of these functions.

Surface-adhesive-rule technology's (SART) cylindrical/rotary system 300 may include a drum 310 on which the SARD's body 320 may be positioned. The body 320 of the SARD may be associated with or joined to the drum 310 using a variety of techniques including, but not limited to: adhesion, gripers, molding, coating, vacuum, etc. In exemplary embodiments, the body 320 of the SARD may be removed from the drum 310 after the SARs 360-363 have been drawn. In other exemplary embodiments, the body 320 of the SARD may be left on the drum 310, to be used for cutting/creasing/embossing cardboards operations in a cylindrical/rotary system, for example. In some exemplary embodiments, SART's cylindrical/rotary system 300 may include one or more drums.

The SARs 360-363 on the body 320 of the SARD may be flexible enough to bend even after hardening, but still rigid enough to serve their purposes of cutting, creasing and/or embossing.

SART's cylindrical/rotary system 300 may further include one or more rule-drawers. Exemplary embodiments of the rule-drawer may comprise: one or more drawing heads 335, a controller 370, and one or more rails 330 to act as a leading mechanism. The drawing head 335 may comprise: one or more multiple-orifice nozzles 340, one or more fluidly flexible material feeding mechanisms 345 (cartridge, for example) associated with the multiple-orifice nozzle 340. The multiple-orifice nozzle 340 may be associated with the rail 330. In exemplary embodiments, the multiple-orifice nozzle 340 may slide upon the rail 330. In exemplary embodiments, the cartridge 345 is associated with the rail 330 as well. In other exemplary embodiments, the cartridge 345 may be independent from the rail 330. Cartridge 345 may comprise flexible material that will be output by one or more orifices of the at least one multiple-orifice nozzle 340, thus drawing SARs 360-363, for example.

In exemplary embodiments, the cartridge 345 and the multiple-orifice nozzle 340 may be associated with or controlled by a motor for moving the cartridge 345 and/or multiple-orifice nozzle 340 back and forth on rail 330 in a direction indicated by arrow 350. In addition, the multiple-orifice nozzle 340 may be adapted to rotate in the directions indicated by arrows 352. Optionally, multiple-orifice nozzle 340 may also move up and down in the directions indicated by arrows 354. It should be noted, in some embodiments, the drawing-head 335 may be used as a single unit, while in other embodiments the multiple-orifice nozzle 340 and/or the cartridge 345 may be moved independent from each other.

Drum 310 may be adapted to rotate in a counter-clockwise direction indicated by arrow 355. Optionally, drum 310 may rotate in a direction opposite to the direction indicated by arrow 355 (i.e., clockwise), and yet in some exemplary embodiments, the drum 310 may rotate in both directions and be stopped at particular points or orientations, stepped in either direction or continuously fed at varying speeds. Further, the drum 310 may also be configured to move laterally in relationship to the rail. The controller 370 may operate to control and coordinate the movement and operations of the different modules or elements, as well as the operations of the SART's cylindrical/rotary system 300. For instance, the controller 370 may operate to control the rotation of the drum 310, the movement of the multiple-orifice nozzle 340 and the cartridge 345. The controller 370 may also instruct and control the multiple-orifice nozzle 340 and cartridge 345 to deposit flexible material on the SAR die's body 320 in order to draw a desired layout of SAR 360-363.

The multiple-orifice nozzle 340 may output flexible material while moving in different directions. Exemplary directions may include, but are not limited to: directions indicated by arrows 350, 352 and/or 354 on rail 330 while drum 310 may move in the direction 355 and/or opposite to 355 as well as other directions. For example, in order to output, and thus draw SAR 361, drum 310 may move in a direction 355 (or opposite to this direction) while the multiple-orifice nozzle 340 may remain in place after the relevant orifice has been positioned in the relevant area and with the correct orientation.

After the circumferential line SAR 361 is completed, the multiple-orifice nozzle 340 may be moved in direction 350 to draw SAR 362, after placing the relevant orifice and/or relevant-orifice's area in the opposite direction of the movement of the multiple-orifice nozzle 340, while the drum 310 may remain stationary. Thus the flexible material will be deposited and pulled through the required peripheral orifice. Likewise, the SAR 362 may be drawn by moving the drum 310 in the direction of arrow 350 while the multiple-orifice nozzle 340 remains stationary, after placing the relevant orifice and/or relevant-orifice's area in the direction similar to the movement of the drum 310. Thus, the flexible material will be deposited and pulled through the required peripheral orifice. Furthermore, SAR 362 may be drawn by moving the drum 310 in one direction along the path of arrow 350 and moving the multiple-orifice nozzle 340 in an opposite direction, again after placing the relevant orifice and/or orifice's relevant area at direction similar to the drum 310 direction, etc.

In an exemplary embodiment, the SARs 360-363 may be drawn in one continuous deposit of flexible material by multiple-orifice nozzle 340. Alternatively, the SARs 360-363 may be drawn by depositing a plurality of layers, each layer may comprise different flexible materials.

During the production of a single SARD 320, the drum 310 may rotate several times on its axis while the multiple-orifice nozzle 340 may move a single time on rail 330. In other embodiments, the drum 310 may rotate a single time around its axis while multiple-orifice nozzle 340 moves several times in different directions. Optionally, the multiple-orifice nozzle 340 may be moved along rail 330 at the same time as drum 310 rotates to draw a diagonal and/or curved SAR. The speed and/or direction of rotation and/or movement of the multiple-orifice nozzle 340 may depend on: the type and form of flexible material output, the section of the SAR 360-363 being drawn, the exposed area of the orifice, the layout, etc. The speed and/or direction of rotation and the movement of the multiple-orifice nozzle 340 may be controlled by controller 370, for example.

The flexible material output by the multiple-orifice nozzle 340 may be hardened after and/or while the drawing is being performed. The hardening may be accomplished by a hardener 380. The hardener 380 may be a source of radiation, and operate to irradiate energy that can cause the drawn flexible material to harden/cure and/or adhere. Irradiated energy may include, but is not limited to: ultra violet (UV) light, visible light, heat, humidity, etc. Alternatively, cooler air may be directed at the drawn flexible material to cool and thus harden the material.

The type of energy irradiated by the hardener 380 generally depends on the type of flexible material and the hardening characteristics of that material. For example, when the flexible material is a thermosetting material, heat may be applied by the hardener 380. When the flexible material is a thermoplastic material, the hardener 380 may cool the material in order to harden it. Yet, when the flexible material is comprised of photo-initiator ingredients, the hardener 380 may illuminate UV lighting in order to harden the flexible material. Optionally, when one or more flexible materials are utilized, one or more types of hardeners 380 may be used.

Other exemplary embodiments of SART may be implemented as a flat system SART instead of the cylindrical/rotary system 300. More information pertaining to flat system SARTs may be found in application Method and system for surface adhesive rule technology" having Ser. No. 13/108,389 which was incorporated herein above by reference.

Figure 4:
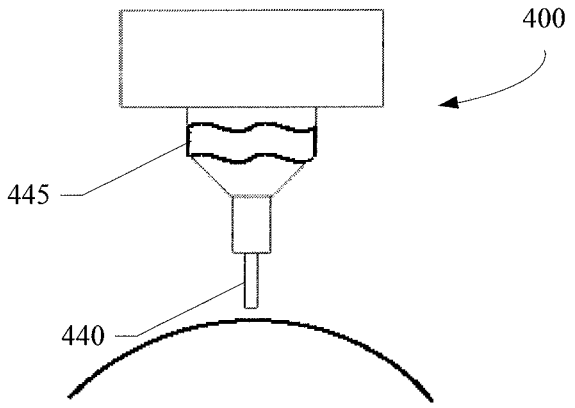
FIG. 4 depicts a schematic illustrations of a simplified diagrams with relevant elements of an exemplary multiple-orifice nozzle and cartridges of a rule-drawer, according to exemplary teaching of the present disclosure.

FIG. 4 depicts relevant elements of an exemplary embodiment of a drawing-head 400. The drawing-head 400 may include a multiple-orifice nozzle 440 for depositing flexible material. The multiple-orifice nozzle 440 may be associated with or fluidly coupled to a cartridge 445. The cartridge 445 may contain flexible material and be associated with a pressure actuator (not shown in the drawing) for depositing the flexible material by injecting it or forcing it through the multiple-orifice nozzle 440 to draw a desired SAR. In some embodiments, the multiple-orifice nozzle 440 and its orifices may have various profiles. More information on the different profiles and orifices is disclosed in conjunction with the description of FIGS. 5*a-e* and FIGS. 7*a-c*.

FIG. 5*a* is a schematic illustration of relevant elements of an exemplary multiple-orifice nozzle 500*a*. The exemplary embodiment of the multiple-orifice nozzle 500*a* may include a tube 502 that may be substantially perpendicular to the surface of a die (not shown in drawing) on which the SAR will be drawn. Wherein substantially perpendicular may be in the range of 90 degree plus/minus 30 degrees, for example. It should be appreciated; however, that in some embodiments the orientation of the tube can be at other angles relative to the SARD and further, in some embodiments the tube orientation of the tube can actually be adjusted manually or by a controller to any orientation over a range of angles, such as 180 degrees of rotation. The multiple-orifice nozzle 500*a* may have two or more peripheral orifices 504 and 506 for example. The bottom of the tube 502 (the part substantially facing the surface of the die) may have an orifice as well. In FIG. 5*a* the orifice is circular having a similar diameter as the diameter of the tube 502. In alternate embodiments the bottom orifice area may be of a different profile and/or size, such as but not limited to: circular, bone-like profile, rectangular, etc. Further, in some embodiments the bottom of the tube 502 may be closed. In yet further embodiments, the bottom of the tube 502 may include and aperture that can be closed or opened to different sizes and/or shapes.

The orifices 504 and 506 may have different profiles. In other embodiments the shape of the orifices may be similar (for redundancy matters, for example). The profiles of the orifices may be determined according to the required SAR profiles, for example. Orifice 506 may be utilized to draw a creasing SAR that will crease a cardboard lengthwise to the cardboard fibers, for example. While orifice 504 may be used to draw a creasing SAR that will crease a cardboard across the cardboard fibers, for example.

Figure 5D:
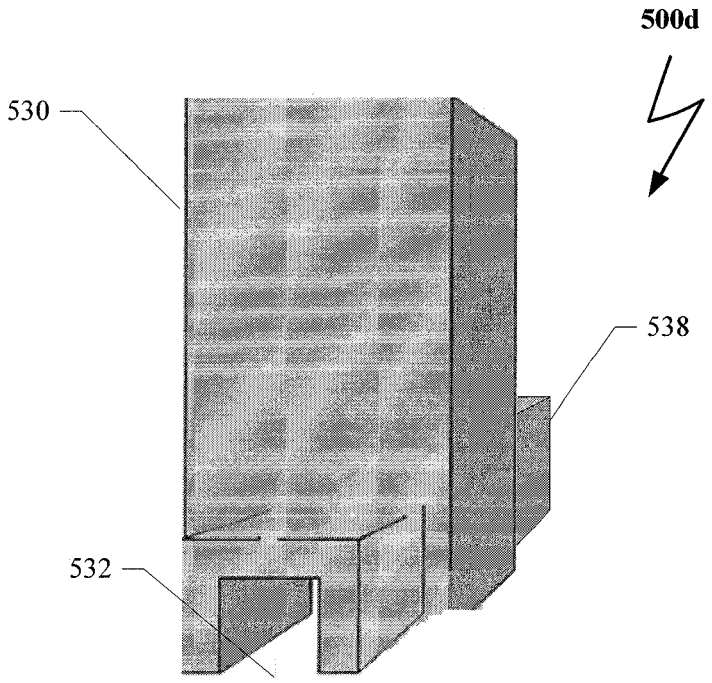

FIG. 5*b* is a schematic illustration of relevant elements of the exemplary multiple-orifice nozzle 500*b*, which is similar to multiple-orifice nozzle 500*a* when viewed facing orifice 506. FIG. 5*c* is a schematic illustration of relevant elements of exemplary multiple-orifice nozzle 500*c*, which is similar to multiple-orifice nozzle 500*b* when viewed from cross-section A-A. FIG. 5*d* is schematic illustration of relevant elements of the exemplary multiple-orifice nozzle 500*d*. The exemplary embodiment of the multiple-orifice nozzle 500*d* may include a tube 530 that may be substantially perpendicular to the surface of a die (not shown in drawing) on which the SAR will be drawn. Wherein substantially perpendicular may be in the range of 90 degree plus/minus 30 degrees as described above, or varied as presented above relative to tube 502 in FIG. 5*a*. The multiple-orifice nozzle 500*d* may have two or more peripheral orifices 532 and 538 for example. The bottom of the tube 530 (the part substantially facing the surface of the die) may have an orifice as well or may be configured similar to the alternate embodiments described in connection with tube 502 as presented in FIG. 5*a*.

The orifices 532 and 538 may have different profiles. In other embodiments the shape of the orifices may be similar (for redundancy matters, for example). The profiles of the orifices may be determined according to the required SAR profiles, for example. Orifice orifices 532 and 538 may comprise a channel-like shape, for example.

Figure 5E:
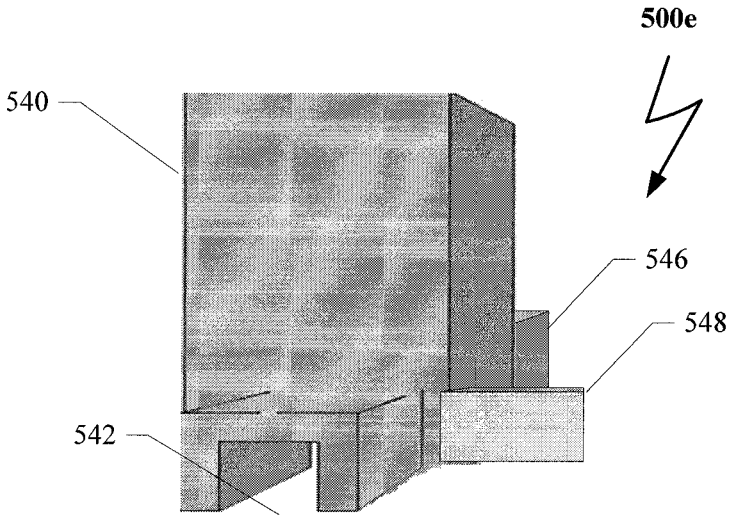

FIG. 5*e* is schematic illustration of relevant elements of the exemplary multiple-orifice nozzle 500*e*. The exemplary embodiment of the multiple-orifice nozzle 500*e* may include a tube 540 that may be substantially perpendicular to the surface of a die (not shown in drawing) on which the SAR will be drawn. The multiple-orifice nozzle 500*e* may have three or more peripheral orifices 542, 546, and 548 for example. The bottom of the tube 540 (the part substantially facing the surface of the die) may have an orifice as well.

The dimensions/sizes of the multiple-orifice nozzle may vary regarding the system requirements. As a non-limiting example, in one embodiment of a multiple-orifice nozzle depicted in FIGS. 5*a*-5*c*, the nozzle tube 502 may have a height 510 of a few mm (range 10-20 mm, for example) depending on the system requirements; and a diameter 512 of a few mm (2-5 mm, for example) depending on the system requirements. Further, one orifice 506 may have a height 514 of a few mm (2-5 mm, for example) and the other orifice 505 may have a height 516 of a few mm (1.5-3 mm, for example). Further, the base of the orifice 506 may have a length 520 (FIG. 5*b*) of a few mm (1.5 mm, for example) with the top cover/rib 522 of a few mm (0-0.5 mm, for example); etc.

Figure 6A:
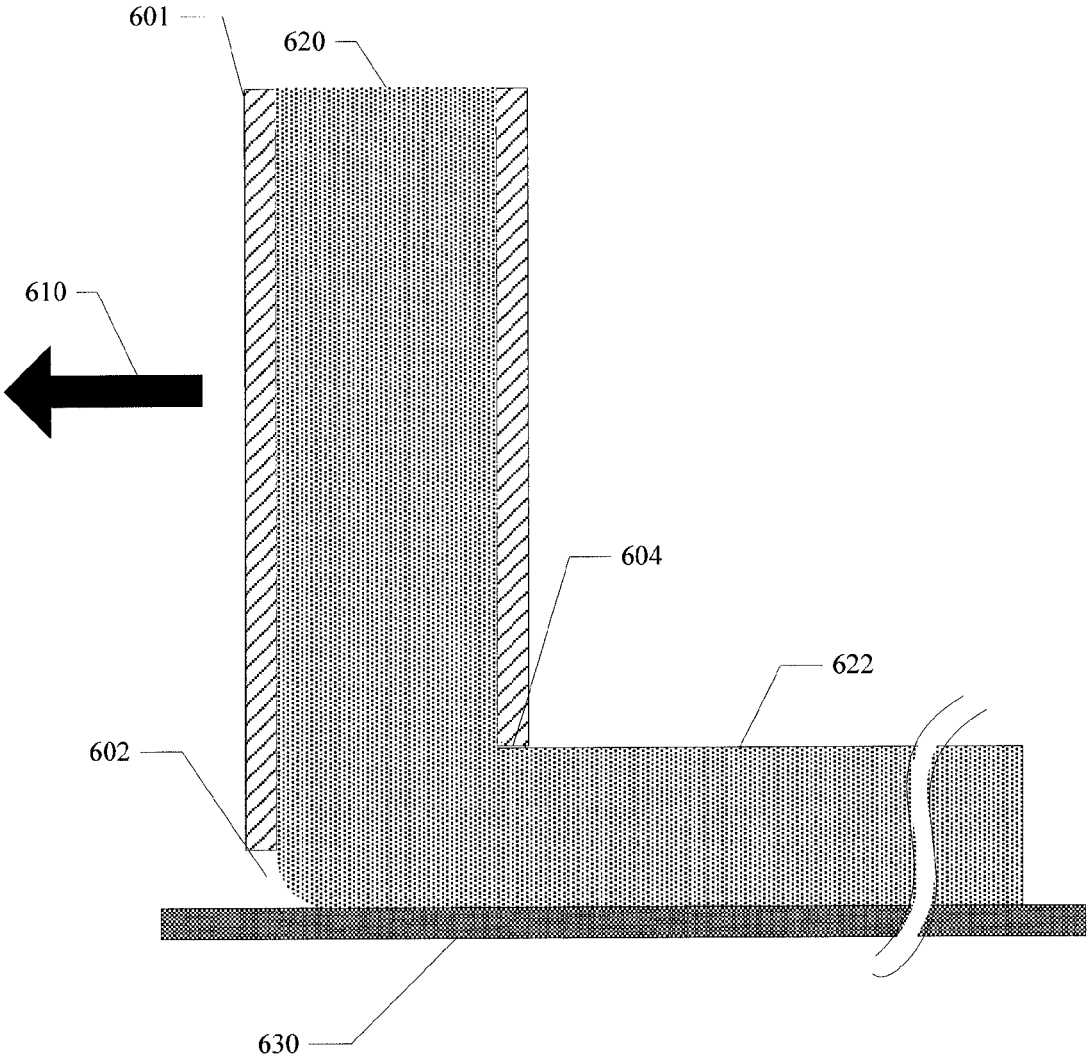
FIGS. 6*a-b* are schematic illustrations of different SAR drawn by a similar multiple-orifice nozzle, according to exemplary teaching of the present disclosure.

FIG. 6*a* depicts a schematic illustration of a partially drawn SAR 622 on a die 630 via a multiple-orifice nozzle 601. The multiple-orifice nozzle 601 may have two peripheral orifices 602 and 604, for example. The multiple-orifice nozzle 601 may further have an orifice substantially facing the die 630. The multiple-orifice nozzle 601 may move in the direction indicated by arrow 610 while a pressure actuator (not shown in the drawing) may operates to feed the flexible material 620 through the multiple-orifice nozzle 601. Thus, the flexible material may be deposited and pulled and output through orifice 604 thereby drawing the SAR 622.

Figure 6B:
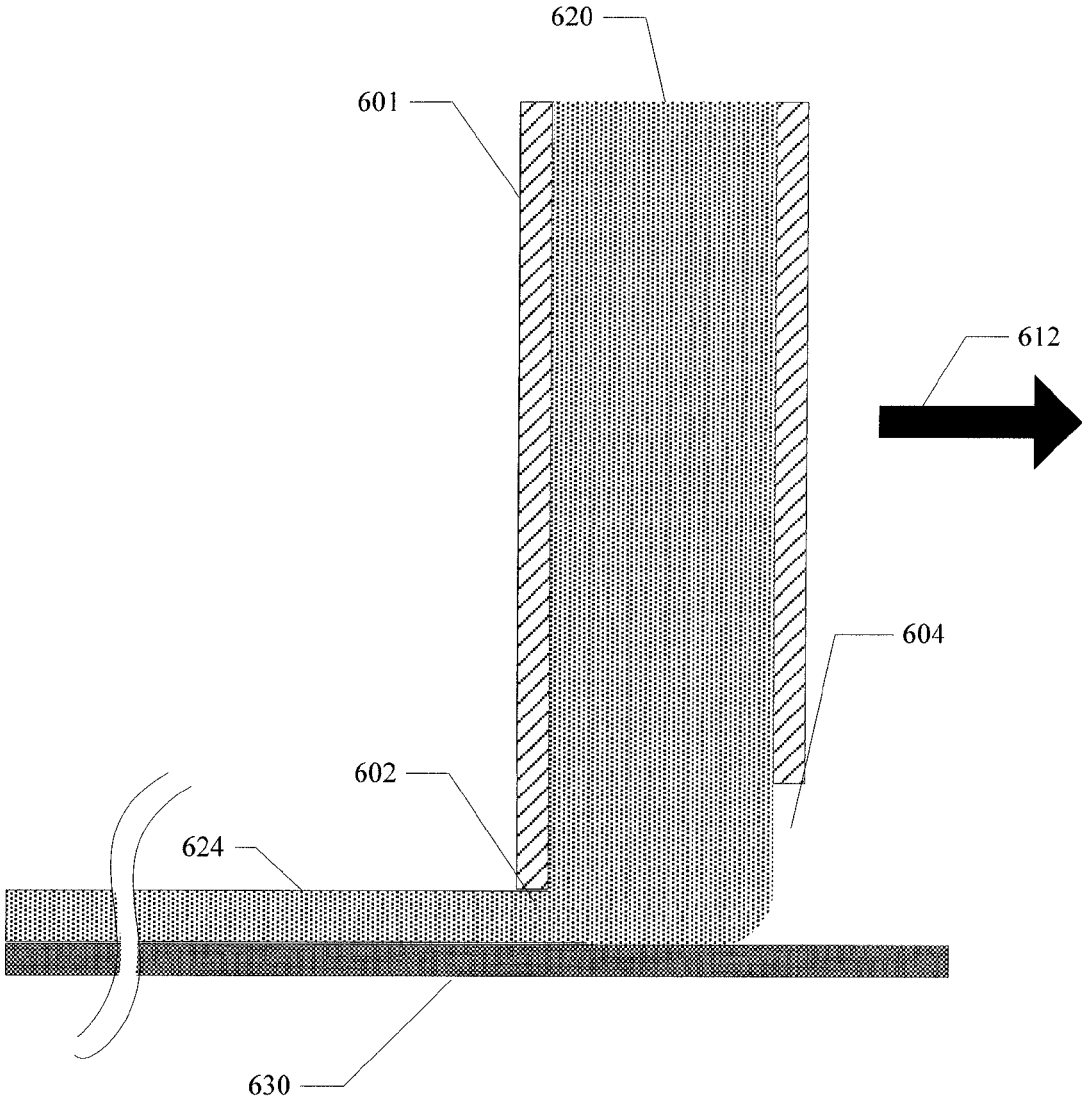

FIG. 6*b* depicts a schematic illustration of a drawing of SAR 624 on a die 630 via a multiple-orifice nozzle 601 similar to the one depicted in FIG. 6*a*. The multiple-orifice nozzle 601 may move in the direction indicated by arrow 612 while a pressure actuator (not shown in the drawing) may force flexible material 620 through the multiple-orifice nozzle 601. Thus, the flexible material may be deposited and pulled and output through orifice 602 thereby drawing the SAR 624.

FIGS. 6*a* and 6*b* depict two different profiled SARs (622 FIGS. 6*a* and 624 FIG. 6*b*) drawn by a similar or the same multiple-orifice nozzle 601, by simply changing the relative movement of the multiple-orifice nozzle 601 and the die (610 FIGS. 6*a* and 612 FIG. 6*b*). In some exemplary embodiments the controller may adapt the pressure enforced by the pressure actuator according to size of the orifice's profile. The controller may further command the leading mechanism to adapt the velocity of the multiple-orifice nozzle 601 movement according to the size of the orifice's profile, etc. The look-up table may comprise the information needed to control the SART for each SAR. Information such as, but not limited to: the flow rate needed for a combination of a SAR profile and the flexible material used; the velocity of the leading mechanism needed for a combination of a SAR profile and the flexible material used, etc.

Figure 7A:
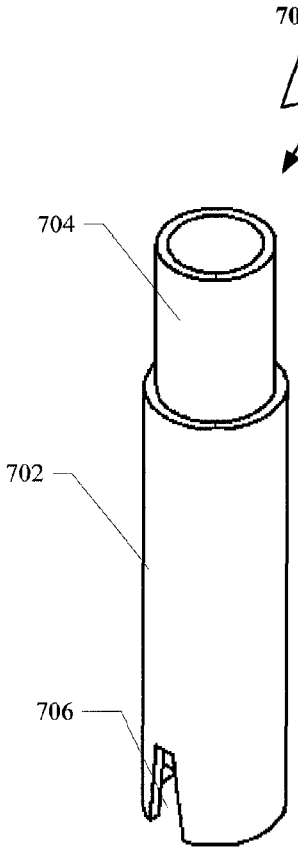

FIG. 7*a* is a schematic illustration of relevant elements of another exemplary embodiment of a multiple-orifice nozzle 700*a*. The exemplary embodiment of the multiple-orifice nozzle 700*a* may include an external tube 702 and an internal tube 704. The external tube 702 and the internal tube 704 are shown as being coaxial, or having a common central axis. However, in other exemplary embodiments, the external tube and internal tube may not have the same central axis. Tubes 702 and 704 may be oriented substantially perpendicular (as defined above) to a SARD's body (not shown in drawing).

External tube 702 may include one or more peripheral orifices through which flexible material may be output toward the surface of a body of a die (not shown in drawing). For simplicity of explanation only one peripheral orifice 706 is shown. The profile and size of the orifice may be predetermined according to the required SARs to be drawn. In the illustrated embodiment, the profile of the orifice is shown as a trapezoid-like profile. In alternate embodiment the profile of the orifice may be triangular or any of a variety of shapes.

External tube 702 may further comprise an orifice at its bottom (area substantially facing the surface of the die). The size and profile of the orifice at the bottom of the external tube 702 may be a circular area with a diameter similar to the diameter of the external tube 702. In alternate embodiment the profile and size of the orifice at the bottom may differ from the profile and size of the external tube 702 or may take on the adjustable characteristics as described above.

In exemplary embodiments, the internal tube 704 may have no peripheral orifices. The internal tube may include an orifice at its bottom (area substantially facing the surface of the die. The size and profile of the orifice at the bottom of internal tube 704 may be a circular area with a diameter similar to the diameter of the internal tube 704. In alternate embodiment the profile and size may differ from the profile and size of the internal tube 704 or may take on the adjustable characteristics as described above.

The internal tube 704 may be lifted or lowered according to commands gotten from a controller, for example. Thus, the internal tube 704 can be lowered to cover a portion of an orifice in the external tube, thus modifying the profile of the orifice. Likewise, the internal tube 704 can be raised such that the profile of the orifice 706 in the external tube 702 is not modified by the internal tube 704. Accordingly the profile of the drawn SAR may be affected by raising and/or lowering the internal tube 704. For example if the internal tube is lifted such that the whole peripheral orifice 706 is exposed, then the SAR drawn through the peripheral orifice will have a profile with a height of X mm from the bottom of the multiple-orifice nozzle 700*a*, for example. If the internal tube 704 is lowered Z mm from the bottom of the multiple-orifice nozzle 700*a*, then the SAR drawn through the peripheral orifice will have a profile with a height of Z mm from the bottom of the multiple-orifice nozzle 700*a* wherein Z is smaller than X, for example.

Further external tube 704 may be rotated around its center a few mm arc (0.5 mm for example) thus narrowing the exposed area and creating yet another SAR profile that will enable drawing a different SAR. This embodiment may be used when drawing a SAR close to another SAR, for example.

Figure 7C:
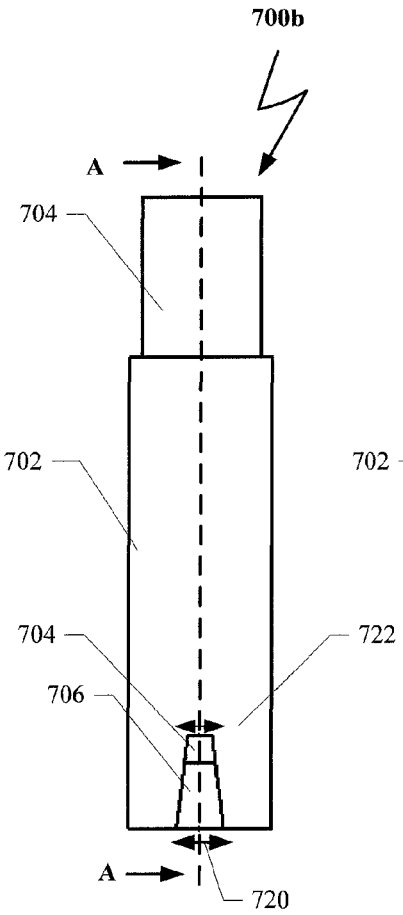
Figure 7C:
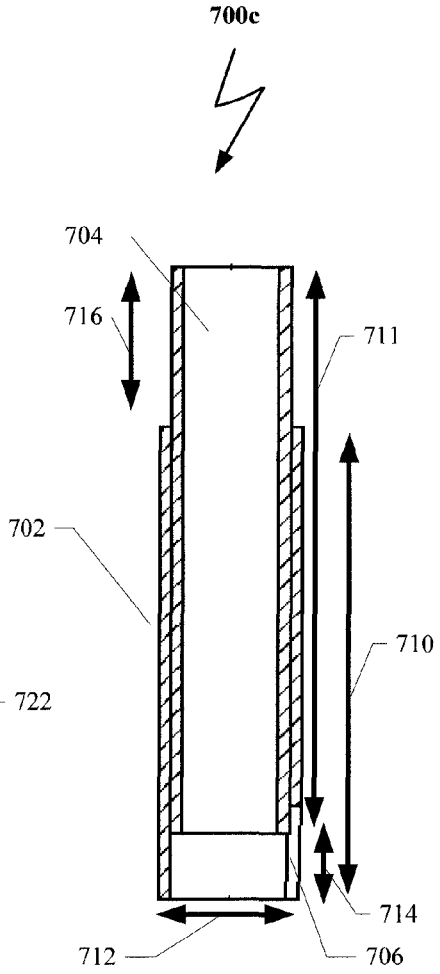

FIG. 7*b* is a schematic illustration of relevant elements of the exemplary multiple-orifice nozzle 700*b*, which is similar to multiple-orifice nozzle 700*a* when viewed facing orifice 706. FIG. 7*c* is a schematic illustration of relevant elements of the exemplary multiple-orifice nozzle 700*c* which is similar to multiple-orifice nozzle 700*b* when viewed from cross-section A-A.

The dimensions/sizes of the multiple-orifice nozzle may vary based on the system requirements. As a non-limiting example the size of the external tube 702 may have a height 710 of a few mm (i.e., approximately 15 mm) and the internal tube 702 may have a height 711 of a few mm (i.e. approximately 15 mm plus or minus) according to the systems requirements and what is needed to be drawn. Further, the diameter 712 of the internal tube 704 and/or the external tube 702 may be a few mm (2 mm, for example) according to the systems requirements and what is needed to be drawn. The height 714 of one of the peripheral orifices may be a few mm (2 mm, for example), the length 720 (FIG. 7*b*) of the base of the peripheral orifice 706 may be a few mm (1.5 mm, for example) and the top cover/rib 722 (FIG. 7*b*) of the peripheral orifice 706 may be a few mm (0-0.5 mm, for example) according to the systems requirements and what is needed to be drawn.

In some exemplary embodiments the internal tube 704 may have one or more peripheral orifices (not shown in drawings), in such cases the combination of the orifice area of the internal tube and the external tube (as a result of the height and/or rotation of the internal tube 704, for example) may determine and alter the profile of the SAR drawn from it. For example, the inner tube 704 may include one or more orifices that have a smaller profile than the orifices of the external tube 702. In such a scenario, lowering the inner tube 704 and aligning the orifice of the inner tube 704 with an orifice of the external tube 702 may result in a completely different profile or a similar profile of smaller dimensions. As a non-limiting example, an orifice in the external tube 702 may have a top that is rectangular in shape. However, lowering the inner tube 704 could result in altering to top to be rounded or pointed. In other embodiments, the orifices of the inner tube 704 and the external tube 702 can be configured such that when the inner tube 704 is positioned at differing heights and rotation alignments relative to an orifice in the external tube, that a wide variety of profiles can be created. It should also be appreciated that more than one internal tube may be employed. In such embodiments, even further modifications of the orifice profile can be achieved.

In an exemplary embodiment, the internal tube 704 may be utilized as part of a cut-off mechanism to terminate a SAR at the end of a drawing of a SAR for example. The cut-off mechanism may include the following actions: the pressure actuator may stop or reduce the application of pressure on the flexible material; the internal tube 704 may by lowered sharply all the way to the bottom of the multiple-orifice nozzle 700*a* toward the surface of the die. In exemplary embodiment the multiple-orifice nozzle 700*a* may further be spun or rotated sharply around its center at 180 degree to facilitate the cutting or terminating of the SAR. In some embodiments the pressure actuator may apply suction during the cut-off mechanism.

Other multiple-orifice nozzles may be used in accordance with embodiments of the present disclosure. The types of multiple-orifice nozzles used may differ according to: the material that is being output onto the SARD, the required profile of the SAR, etc. In some exemplary embodiments, the orifice of the multiple-orifice nozzle may be directed in a direction opposite to the relative direction of motion of the multiple-orifice nozzle with respect to the surface of the SARD's body. Thus pulling the flexible material through the relevant orifice. In other embodiments, the orifice of the multiple-orifice nozzle may be parallel to the surface of the SARD's body. In alternate embodiments the multiple-orifice nozzle may be at a pre-defined angle to the surface of the SARD's. Exemplary angles may be at the range of 60-120 degrees.

Figure 8A:
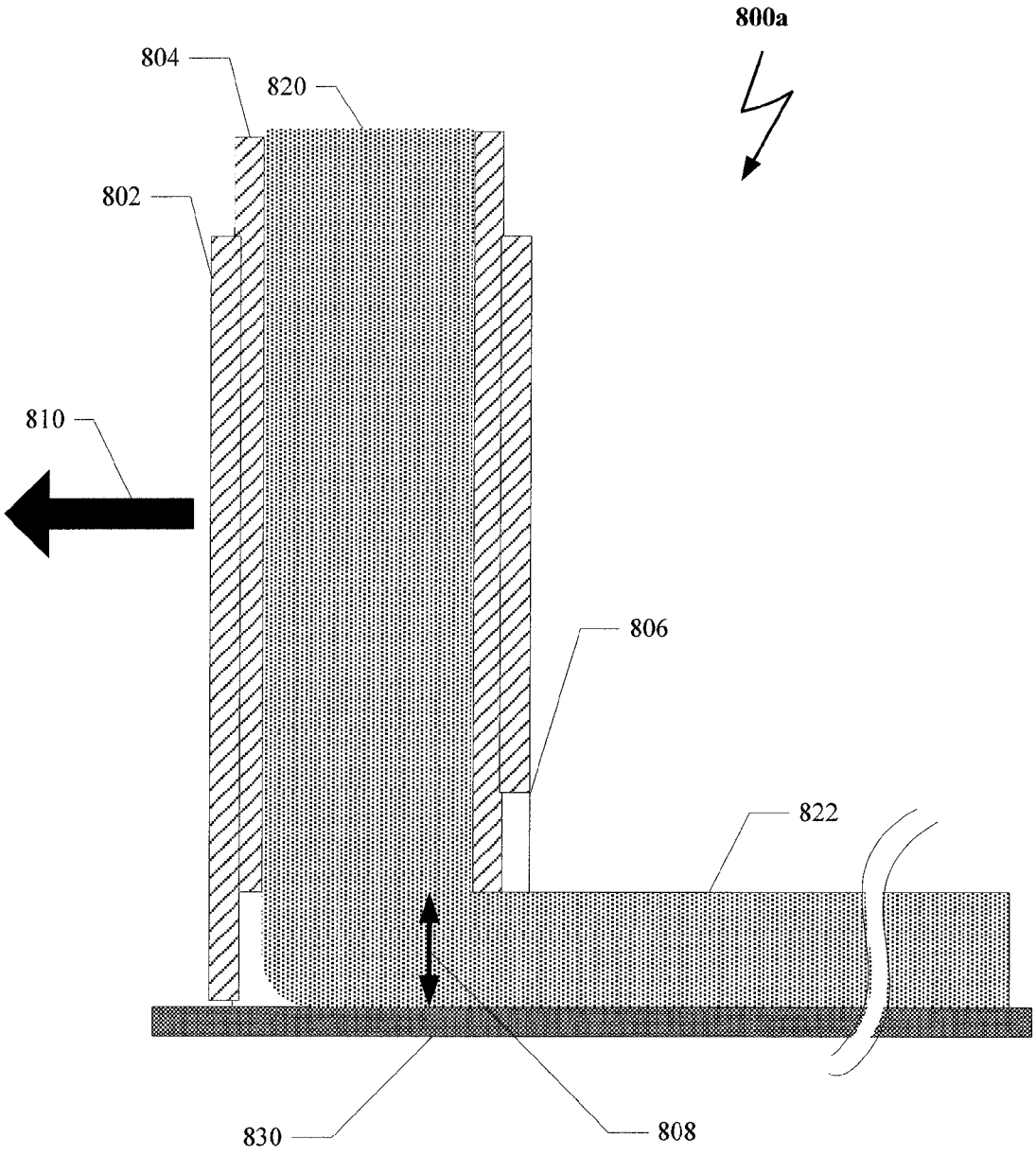
FIGS. 8*a-b* are schematic illustrations of different SAR drawn by a similar multiple-orifice nozzle, according to exemplary teaching of the present disclosure.

FIG. 8*a* depicts a schematic illustration of an exemplary embodiment of a drawing of a SAR 822 using relevant elements of an exemplary multiple-orifice nozzle 800*a*. The multiple-orifice nozzle 800*a* may comprise an external tube 802 with a peripheral orifice 806, for example. The external tube 802 may have an orifice at the bottom with a circular profile with a diameter similar to the diameter of the external tube 802, wherein bottom is the area substantially facing a die 830 on which the SAR will be drawn. The multiple-orifice nozzle 800*a* may further comprise an internal tube 804 that may have no peripheral orifices. Internal tube 804 may have a circular profile with a diameter similar to the diameter of the internal tube 804. The internal tube 804 may have an orifice at its bottom, as well.

Internal tube 804 is illustrated as being lifted or positioned at a height marked by arrow 808, from the surface of the die 830, thus exposing part of the external orifice 806 area and covering a portion. A pressure actuator (not shown in drawing) may encourage flexible material 820 through the exposed area of the orifice 806 while the multiple-orifice nozzle moves in the direction 810, thus drawing SAR 822. The SAR 822 may have the profile of the exposed area of the orifice 806 from which it has been output. In an alternate embodiment, the multiple-orifice nozzle 800*a* may remain at a stationary place while the die 830 is moved in direction opposite to arrow 810. In yet another alternate embodiment both the die and the nozzle 800*a* may be moved while drawing the SAR 822.

Figure 8B:
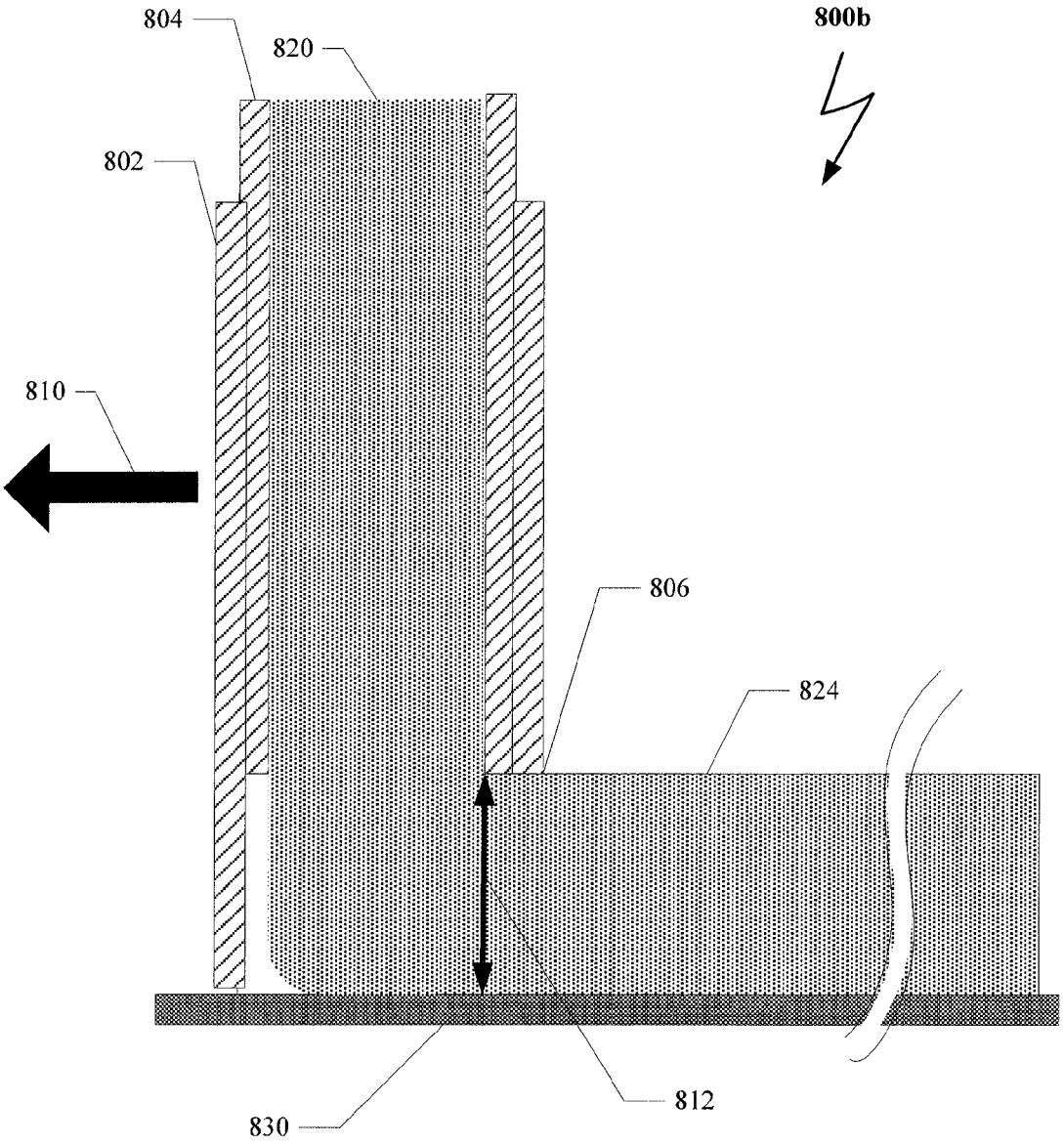

FIG. 8*b* depicts a schematic illustration of an exemplary embodiment of a drawing of a SAR 824 drawing using relevant elements of an exemplary multiple-orifice nozzle 800*b*. Multiple-orifice nozzle 800*b* may be similar to multiple-orifice nozzle 8000*a*, wherein in FIG. 8*b* the internal tube 804 is lifted to an exemplary height, marked by arrow 812, from the surface of the die 830, thus exposing the whole external orifice 806 area. A pressure actuator may encourage flexible material 820 through the exposed area of the orifice 806 while the multiple-orifice nozzle moves in the direction 810, thus drawing the SAR 824. The SAR 824 may have the profile of the orifice 806 from which it has been output. In an alternate embodiment the multiple-orifice nozzle 800*b* may remain at a stationary place while the die 830 is moved in direction opposite to 810. In yet another alternate embodiment both the die and the nozzle 800*a* may be moved while drawing the SAR 822.

FIGS. 9*a-d* schematically illustrates a flowchart showing relevant processes or actions of an exemplary SAR drawing method 900. The illustrated SAR drawing method 900 may be executed by a controller, a microprocessor, a microcontroller, a computer or any other processing device including (collectively referred to as a controller), but not limited to controllers similar to controller 370 (FIG. 3). The method 900 may be initiated 902 upon powering on the controller but, it will be appreciated that the method 900 may be initiated or invoked from other processes, system, events, user actions, etc.

During initiation 902, the controller may operate to detect the various modules in the system or, the various modules or other processors may provide information to the controller to identify the different modules. Exemplary modules may include, but are not limited to: drawing head modules, different registers, different timers, etc. After being invoked, the process may then act to reset 904, initialize and/or determine the state of various resources, registers, variables, memory components, etc. The various resources may include, but are not limited to: timers (t), counters (R), distance measurers (D), and so on.

After the system resources have been initialized 904, the SAR drawing method 900 may enter into a delay loop waiting for the reception of an initiation command 906. The initiation command directs the SAR drawing method 900 to commence the creation of a SARD (surface-adhesive-rule die). When an initiation request is received 906, the method 900 may proceed to act 908 by obtaining the entry of various inputs or parameters used in the creation of the SARD. The inputs may be received, obtained or entered by a user, provided by a processor or other entity, read from an electronic file, etc. Exemplary inputs may include, but are not limited to: the thickness of the cardboard that will be pre-treated while using the SARD, the type of surface-adhesive rules (SAR) that will be required, the requested layout, and so on.

The method 900 may check 910 a look-up table (SAR dependent entry for example) for information on the required job description. Exemplary information may include, but is not limited to: the definition of flow index for each SAR, the definition of profile for each SAR, the type of SAR (cutting/embossing/creasing), the required orifice for each SAR, the required velocity and/or flow rate required to draw each SAR, the material composition/properties required for each SAR, etc.

Once the information has been received, the method then decides whether additional information is needed 912. If additional information is needed 912, then method 900 may prompt the user or other information provider to enter or provide the information 914, and processing then returns to act 908 to check for this information. If the method obtains the information in the look-up table or otherwise 912, then the method 900 may proceed to act 918. The method 900 may then proceed to execute a SAR drawing loop that comprises the acts listed in blocks 918 through 946 (FIGS. 9*a*-9*d*).

The first action in the SAR drawing loop comprises increasing the counter R by one (incrementing R) 918, and the method 900 may begin drawing a SAR in accordance with the information received at action 910 and layout requirements, for example.

Once the counter is increased, the method continues by adjusting and/or setting the required multiple-orifice nozzle 920. The act of adjusting and/or setting the required multiple-orifice nozzle may include, but is not limited to: orienting the multiple-orifice nozzle to face the appropriate direction (for example the required orifice may be placed in a direction opposite to the movement of the nozzle), placing the multiple-orifice nozzle at appropriate angle (substantially 90 degree from the die's surface, for example); placing the multiple-orifice nozzle at the appropriate height; if the multiple-orifice nozzle comprises an internal and external tube then placing the internal tube at the required height and orientation (a few mm from the surface of the die as a non-limiting example); etc.

The velocity of the drawing head modules may be accelerated 920 to a required velocity V1 by acceleration rate a1, for example. The pressure applied by one or more pressure actuators may also be raised 920 to a required pressure P1. The velocity and pressure may be determined according to the different criteria. Exemplary criteria may be: the flexible material attributes (viscosity, hardness, etc), the SAR profile and thus the orifice surface area, etc. Yet, in alternate embodiments, in which screw-pumps are used for example, instead of raising pressure P1, a screwing speed may be raised. Next the method 900 may proceed to act 922 at FIG. 9*b*.

After adjusting and/or setting the multiple-orifice nozzle, velocity and pressure, the method continues by entering a delay loop 922 until the value of timer t is equal to t1. The value of t1 may be calculated according to: flexible material attributes, the SAR profile and thus the orifice surface profile, the mechanical capabilities of the drawing-head, and so on. When timer t value is equal to the value of t1, the acceleration rate a1 of the velocity of the drawing head modules may be stopped 924 and the pressure applied by the pressure actuator may be held at the value P1 924 as well. Thus the drawing head modules may continue 924 drawing at velocity V1 and the pressure actuator may continue 924 the application of pressure at P1.

In an alternate embodiment, instead of using a timer, a distant measurement D may be used. The distant measurement D may be expressed by a number of steps given to a step-motor or by feedback received from a step measurement encoder associated with the drawing head, for example. Other techniques may also be employed in other embodiments.

While the drawing continues, the method 900 may enter into a delay loop until the value of counter t is equal 926 to t2. Wherein t2 may be calculated from inputs on the drawn pattern of the SAR and the velocity that was reached at t1, for example. When the timer t value is equal 926 to t2, the velocity of the drawing head modules may be decelerated 928 to V2 at deceleration rate a2, and the pressure by the pressure actuator may be decreased 928 to P2, for example. In exemplary embodiments, the multiple-orifice nozzle may be 930 elevated X mm and turned 930 to an angle O according to the requirements of the layout. Next the multiple-orifice nozzle may be lowered 930 Z mm (wherein Z may or may not equal X). In alternate embodiments, if the multiple-orifice nozzle has an internal and external tube the height of the internal tube may be changed to the required height, etc.

The method 900 may continue by accelerating 932 the drawing head modules to a velocity of V1 at an acceleration rate of a1, and the pressure applied by the pressure actuator may be raised 932 to P1. The drawing head modules may continue to draw 932 the SARs according to the layout. The method 900 may then proceed to act 934 at FIG. 9*c*.

Figure 9A:
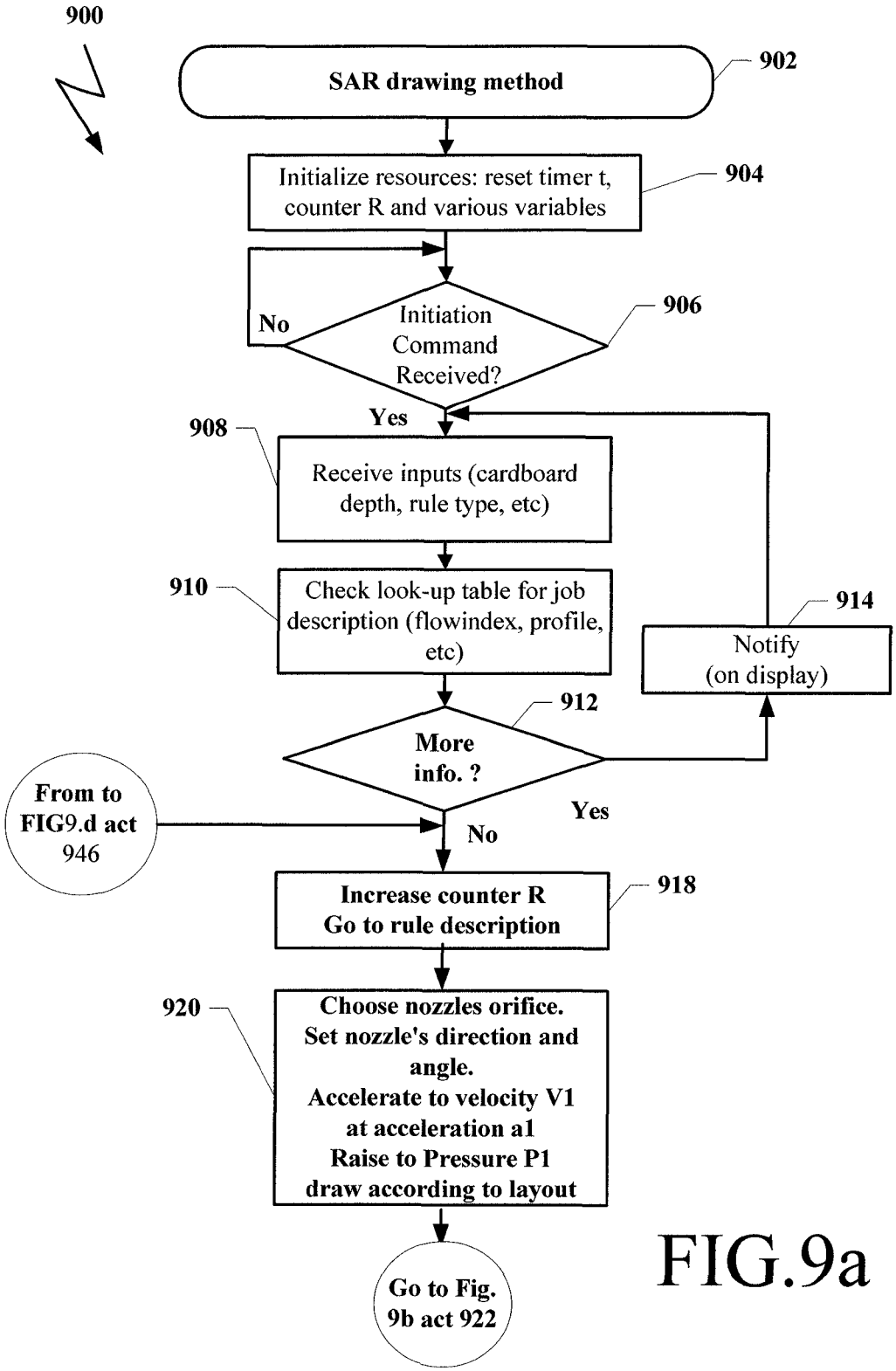
FIGS. 9*a-d* are schematic illustrations of a flowchart showing relevant acts of an exemplary method of a drawing process using exemplary multiple-orifice nozzle, according to exemplary teachings of the present disclosure.
Figure 9B:
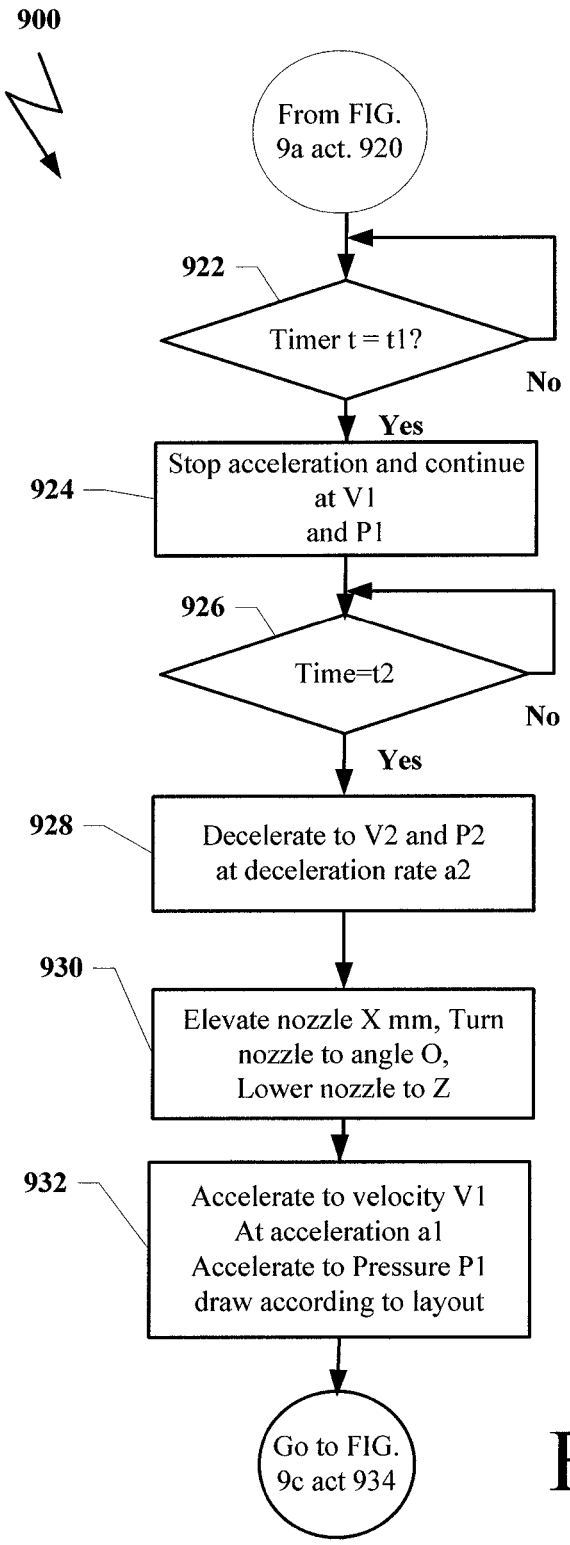
Figure 9C:
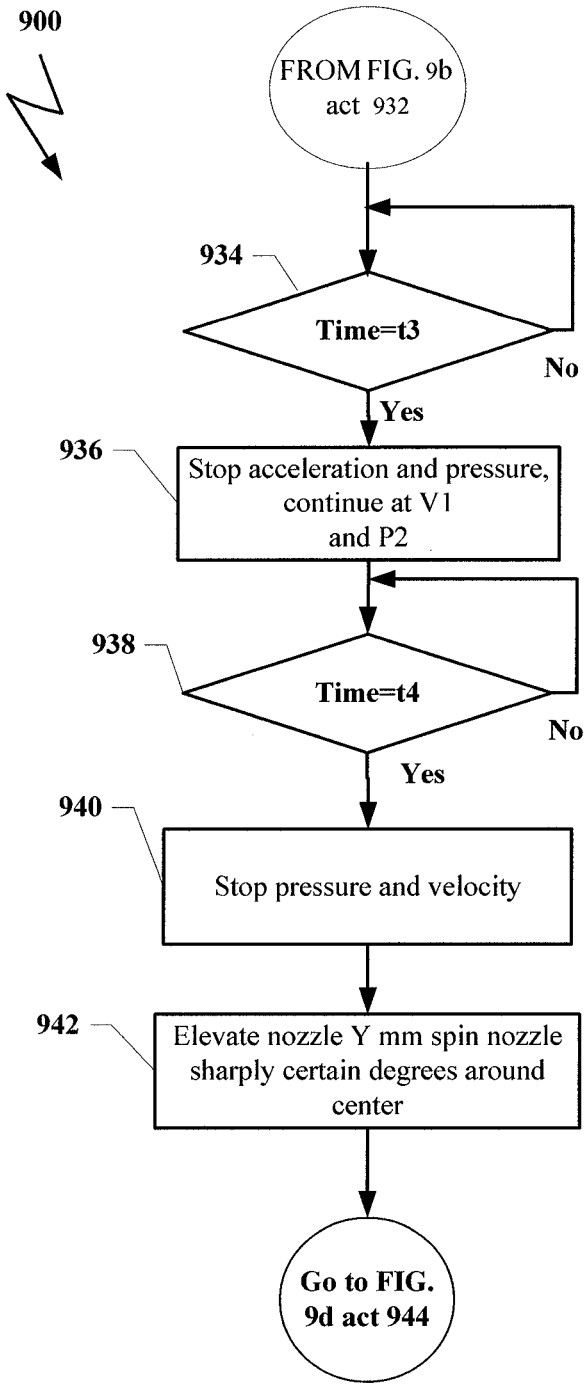
Figure 9D:
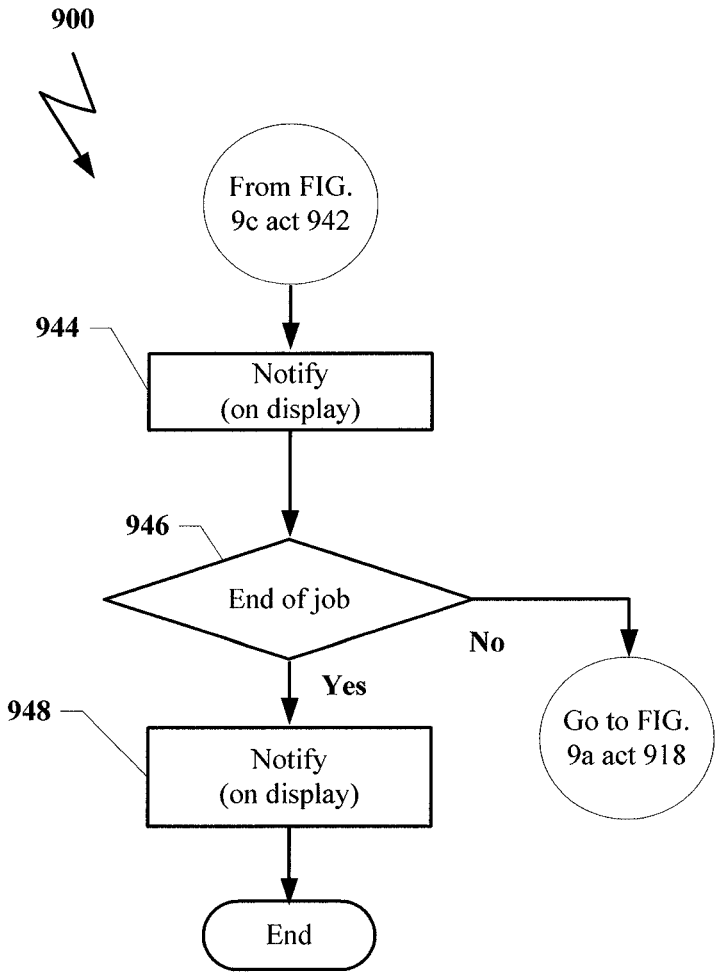

The method 900 continues at act 934 of FIG. 9*c* by entering a delay loop until the value of the timer t is equal 934 to t3. When the timer t value is equal 934 to t3, the acceleration of the velocity of the drawing head modules and the raising of the pressure by the pressure actuator may be stopped 936. The drawing head modules may continue drawing at velocity V1 and the pressure actuator may continue at pressure P1 936. Next, the method 900 may enter a delay loop until the value of timer t is equal 938 to t4.

When the timer t value is equal 938 to t4, the pressure imposed by the pressure actuator may be stopped 940, and the motion of the drawing head modules may be stopped 940 as well. The multiple-orifice nozzle may be elevated to a desired level by raising it Y mm and then spinning it sharply 942 at a certain degrees (180-360 degrees for example) around its center, for example. The spinning of the multiple-orifice nozzle operates to cut the flexible material from the multiple-orifice nozzle. In embodiments of multiple-orifice nozzle that have an internal and external tube the internal tube may be lowered sharply down (toward the surface of the die) and act as a guillotine for example. The method 900 may then proceed to act 944 at FIG. 9*d*.

At this point in the process, the method 900 may provide a notice or indicator 944, such as by turning on a light, making a sound or placing text or icons on a display as non-limiting examples, that this adhesive rule (SAR) has been drawn. Next, the method 900 determines 946 whether all of the SARs have been drawn and the job has been finished. If the job is finished 946, then the method 900 may provide 948 a notice or indicator, such as by turning on a light, making a sound or placing text or icons on a display for example, that the job as been finished and method 900 may end. If the job has not yet been finished and more SARs need to be drawn 946, then method 900 may return to act 918 at FIG. 9*a* to start drawing the next SAR.

In some exemplary embodiments instead of and/or additionally to using timers, the controller may get different feedback from different sensors. Sensors such as, but not limited to: pressure sensors, location sensors (encoders), velocity sensors, etc.

Figure 10:
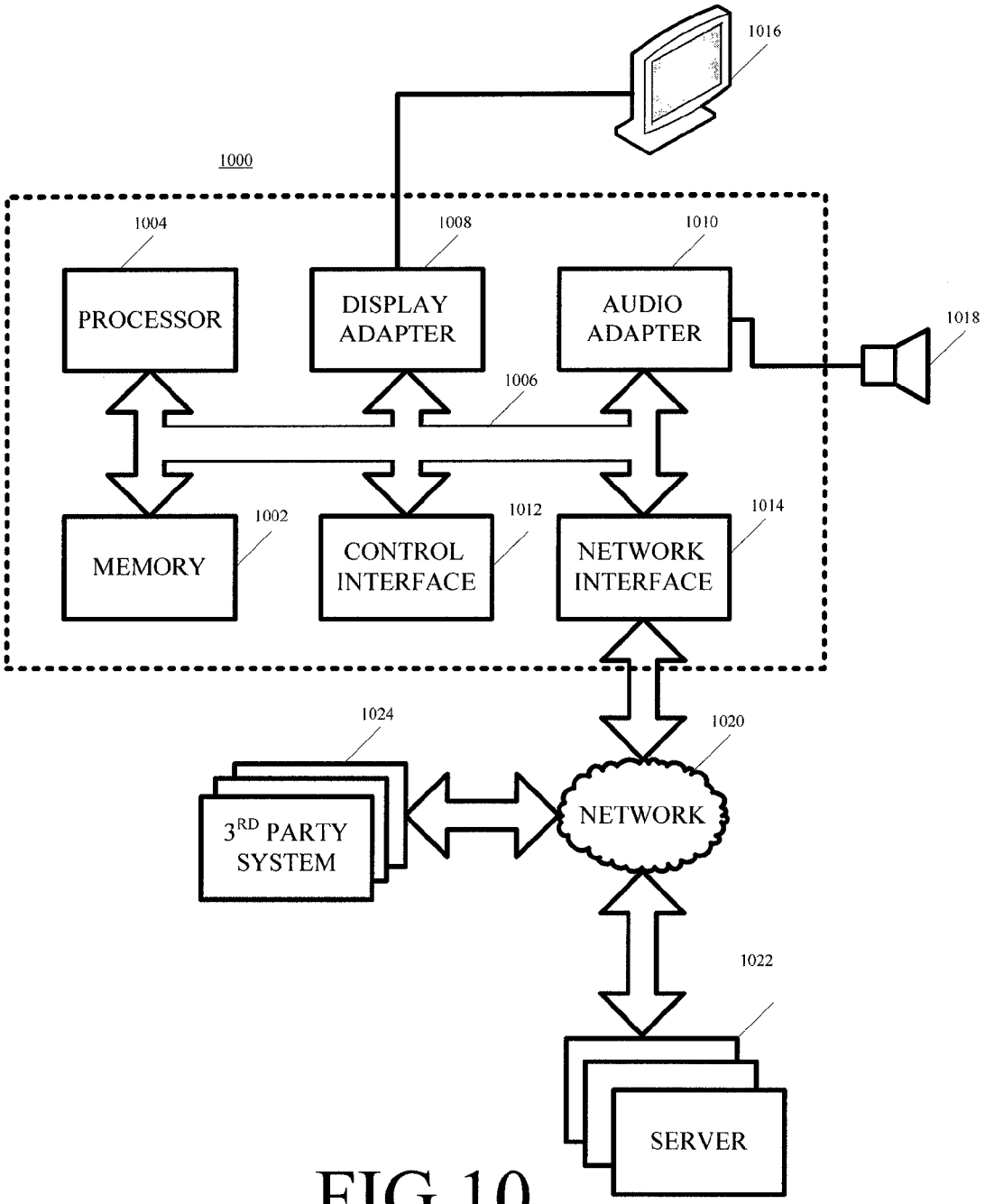
FIG. 10 depicts an exemplary block diagram with relevant elements of system or sub-system operating as a controller, according to teaching of the present disclosure.

FIG. 10 is a functional block diagram of the components of an exemplary embodiment of system or sub-system operating as a controller or processor 1000 that could be used in various embodiments of the disclosure for controlling aspects of the various embodiments. It will be appreciated that not all of the components illustrated in FIG. 10 are required in all embodiments of a controller but, each of the components are presented and described in conjunction with FIG. 10 to provide a complete and overall understanding of the components.

The controller can include a general computing platform 1000 illustrated as including a processor 1002 and memory device 1004 that may be integrated with each other or communicatively connected over a bus or similar interface 1006. The processor 1002 can be a variety of processor types including microprocessors, micro-controllers, programmable arrays, custom IC's etc., and may also include single or multiple processors with or without accelerators or the like. The memory element of 1004 may include a variety of structures, including but not limited to RAM, ROM, magnetic media, optical media, bubble memory, FLASH memory, EPROM, EEPROM, etc.

The processor 1002, or other components in the controller may also provide components such as a real-time clock, analog to digital convertors, digital to analog convertors, etc. The processor 1002 also interfaces to a variety of elements including a control interface 1012, a display adapter 1008, an audio adapter 1010, and a network/device interface 1014. The control interface 1012 provides an interface to external controls such as, but not limited to: sensors, actuators, drawing heads, multiple-orifice nozzles, cartridges, pressure actuators, leading mechanism, drums, step motors, a keyboard, a mouse, a pin pad, an audio activated device, as well as a variety of the many other available input and output devices or, another computer or processing device or the like.

A display adapter 1008 can be used to drive a variety of alert elements 1016, such as, but not limited to: display devices including an LED display, LCD display, one or more LEDs or other display devices. An audio adapter 1010 may interface to and drive another alert element 1018, such as a speaker or speaker system, buzzer, bell, etc. A network/interface 1014 may interface to a network 1020 which may be any type of network including, but not limited to the Internet, a global network, a wide area network, a local area network, a wired network, a wireless network or any other network type including hybrids. Through the network 1020, or even directly, the controller 1000 can interface to other devices or computing platforms such as but not limited to: one or more servers 1022 and/or third party systems 1024. A battery or power source may provide power for the controller 1000.

In the description and claims of the present disclosure, each of the verbs, "comprise", "include" and "have", and conjugates thereof, are used to indicate that the object or objects of the verb are not necessarily a complete listing of members, components, elements, or parts of the subject or subjects of the verb and further, all of the listed objects are not necessarily required in all embodiments.

As used herein, the singular form "a", "an" and "the" include plural references unless the context clearly dictates otherwise. For example, the term "a material" or "at least one material" may include a plurality of materials, including mixtures thereof.

In this disclosure the words "unit", "element", and/or "module" are used interchangeably. Anything designated as a unit, element, and/or module may be a stand-alone unit or a specialized module. A unit, element, and/or module may be modular or have modular aspects allowing it to be easily removed and replaced with another similar unit, element, and/or module. Each unit, element, and/or module may be any one of, or any combination of, software, hardware, and/or firmware. Software of a logical module can be embodied on a computer readable medium such as a read/write hard disc, CDROM, Flash memory, ROM, etc. In order to execute a certain task a software program can be loaded to an appropriate processor as needed.

The present disclosure has been described using detailed descriptions of embodiments thereof that are provided by way of example and are not intended to limit the scope of the disclosure. The described embodiments comprise different features, not all of which are required in all embodiments of the disclosure. Some embodiments of the present disclosure utilize only some of the features or possible combinations of the features. Many other ramifications and variations are possible within the teaching of the embodiments comprising different combinations of features noted in the described embodiments.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable sub-combination or as suitable in any other described embodiment of the invention.

It will be appreciated by persons skilled in the art that the present disclosure is not limited by what has been particularly shown and described herein above. Rather the scope of the disclosure is defined by the claims that follow.

What is claimed is:

1. A rule drawer, comprising:

a drawing-head that comprises a multiple-orifice nozzle having an external tube with a plurality of peripheral orifices, the multiple-orifice nozzle fluidly associated to a cartridge containing a flexible material, the cartridge is associated with a pressure actuator used to encourage the flexible material out of the cartridge through a desirable peripheral orifice profile of the multiple-orifice nozzle;

a moving mechanism; and a controller that controls the drawing-head and the moving mechanism;

wherein the position of the desirable peripheral orifice profile is selected relative to a movement, caused by the moving mechanism, between the multiple-orifice nozzle and a surface onto which a surface-adhesive rule is drawn, and wherein pressure imposed by the pressure actuator on the flexible material operates to deposit the flexible material onto the surface, and the movement of the drawing-head relative to the surface operates to pull the flexible material through the desirable peripheral orifice profile for drawing a surface-adhesive rule, wherein the multiple-orifice nozzle further comprises an internal tube, wherein the relative positioning of the external and internal tubes of the multiple-orifice nozzle can be dynamically altered, and further comprising one or more orifices located at the bottom of the multiple-orifice nozzle, wherein bottom of the multiple-orifice nozzle defines an opening that faces substantially parallel to the surface on which the surface-adhesive rule is drawn, and wherein one or more of the peripheral orifices together with one or more of the opening at the bottom create a continuous opening.

2. The rule drawer of claim 1, wherein the internal tube has one or more orifices at the bottom of the internal tube, wherein bottom defines an opening that faces substantially parallel to the surface on which the surface-adhesive rule is drawn.

3. The rule drawer of claim 1, wherein one of the external or internal tubes is configured to cut the flexible material extending through the desirable peripheral orifice profile in response to receiving a command from a controller.

4. The rule drawer of claim 1, wherein the relative positioning of the external and internal tubes between themselves is dynamically altered by rotating at least one of the external or internal tubes around its center thus exposing a desired peripheral orifice profile.

5. The multiple-orifice nozzle of claim 1, wherein the multiple-orifice nozzle is rotatable around its center.

6. The multiple-orifice nozzle of claim 1, wherein at least two of the peripheral orifices differ from each other in their profile.

7. The multiple-orifice nozzle of claim 1, wherein one or more of the peripheral orifices has a trapezoidal profile.

8. The multiple-orifice nozzle of claim 1, wherein the position of a desirable peripheral orifice profile is set by tilting the multiple-orifice nozzle toward the surface on which the flexible material is drawn, based at least in part on the desired peripheral orifice profile.

9. The multiple-orifice nozzle of claim 8, wherein a tilting angle is substantially 60 degrees.

10. The multiple-orifice nozzle of claim 1, wherein the flexible material is a liquid or gel like material comprising one or more types of polymers and has attribute to reserve the profile of the desirable peripheral orifice through which the flexible material is deposited from.

11. The multiple-orifice nozzle of claim 1, wherein the desirable peripheral orifice profile is selected, based at least in part, in accordance with the placement of the drawn surface-adhesive rule on the surface of a die in relation to a drum with which the die is associated.

12. The multiple-orifice nozzle of claim 1, wherein the desirable peripheral orifice profile corresponds to an attribute of a cardboard to be creased.

13. The multiple-orifice nozzle of claim 1, wherein the desirable peripheral orifice profile corresponds to an attribute of the flexible material within the cartridge.

14. The multiple-orifice nozzle of claim 1, wherein the desirable peripheral orifice profile selected, based at least in part, in accordance with a required surface-adhesive rule type.

15. The multiple-orifice nozzle of claim 1, wherein the peripheral orifice is selected, based at least in part, in accordance with a distance to an adjacent surface-adhesive rule.

16. The multiple-orifice nozzle of claim 1, wherein the position of a desirable peripheral orifice profile is changed dynamically while drawing a combinational surface-adhesive rule.

17. The multiple-orifice nozzle of claim 1, wherein both the internal tube and external tube have one or more peripheral orifices, and wherein nozzle relative positioning of the tubes between themselves create a pre-defined orifice through which the flexible material is deposited and pulled from during the relative movement between the multiple-orifice nozzle and the surface on which a surface-adhesive rule is drawn.

18. The multiple-orifice nozzle of claim 1, wherein the tubes relative positioning between themselves is dynamically altered by adjusting the height of at least one of the tubes relative to the bottom of the multiple-orifice nozzle to expose a desired peripheral orifice profile.

19. The multiple-orifice nozzle of claim 1, further comprising applying pressure by the pressure actuator on the flexible material according to the desired orifice profile.

20. The multiple-orifice nozzle of claim 1, further comprising controlling the velocity of the relative movement according to the desired orifice profile.

21. The rule drawer of claim 1, wherein at least two of the peripheral orifices differ from each other in their profile.

22. The rule drawer of claim 1, wherein the position of a desirable peripheral orifice profile is set by tilting the multiple-orifice nozzle toward the surface on which the flexible material is drawn, based at least in part on the desired peripheral orifice profile.

23. The rule drawer of claim 22, wherein the tilting angle is substantially 60 degrees.

24. The rule drawer of claim 1, wherein the desirable peripheral orifice profile corresponds to an attribute of a cardboard to be creased.

25. The rule drawer of claim 1, wherein both the internal tube and external tube have one or more peripheral orifices, and wherein nozzle relative positioning of the tubes between themselves create a pre-defined orifice through which the flexible material is deposited and pulled from during the relative movement between the multiple-orifice nozzle and the surface on which a surface-adhesive rule is drawn.

26. The rule drawer of claim 1, wherein the tubes relative positioning between themselves is dynamically altered by adjusting the height of at least one of the tubes relative to the bottom of the multiple-orifice nozzle to expose a desired peripheral orifice profile.

27. The rule drawer of claim 1, further comprising applying pressure by the pressure actuator on the flexible material according to the desired orifice profile.

28. The rule drawer of claim 1, further comprising controlling the velocity of the relative movement according to the desired orifice profile.

29. The rule drawer of claim 1, wherein the surface on which the flexible material is drawn is associated with the moving mechanism.

30. The rule drawer of claim 1, wherein the moving mechanism is a leading mechanism associated with the multiple-orifice nozzle.

31. The rule drawer of claim 1, wherein the moving mechanism is a leading mechanism associated with the multiple-orifice nozzle and wherein the position of a desirable peripheral orifice profile is such that the position of a desirable area of the desirable peripheral orifice, of the multiple-orifice nozzle, faces a direction opposite to the multiple-orifice nozzle movement direction.

32. The rule drawer of claim 1, wherein the surface on which the flexible material is drawn is associated with the moving mechanism and wherein the position of a desirable peripheral orifice profile is such that the position of a desirable area of the desirable peripheral orifice, of the multiple-orifice nozzle, faces a direction similar to the movement of the surface on which the flexible material is drawn.

* * * * *